US009506459B2

(12) United States Patent
Ota et al.

(10) Patent No.: US 9,506,459 B2
(45) Date of Patent: Nov. 29, 2016

(54) VARIABLE DISPLACEMENT SWASH PLATE TYPE COMPRESSOR

(71) Applicant: KABUSHIKI KAISHA TOYOTA JIDOSHOKKI, Kariya-shi, Aichi-ken (JP)

(72) Inventors: Masaki Ota, Kariya (JP); Takahiro Suzuki, Kariya (JP); Kei Nishii, Kariya (JP); Koji Kawamura, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 126 days.

(21) Appl. No.: 14/642,017

(22) Filed: Mar. 9, 2015

(65) Prior Publication Data

US 2015/0275875 A1 Oct. 1, 2015

(30) Foreign Application Priority Data

Mar. 25, 2014 (JP) ..... 2014-061833

(51) Int. Cl.

*F04B 27/18* (2006.01)
*F04B 39/10* (2006.01)
*F04B 39/12* (2006.01)
(Continued)

(52) U.S. Cl.

CPC ..... *F04B 27/1804* (2013.01); *F04B 1/295* (2013.01); *F04B 27/18* (2013.01); *F04B 27/1054* (2013.01); *F04B 2027/1809* (2013.01); *F04B 2027/1813* (2013.01); *F04B 2027/1827* (2013.01); *F04B 2027/1831* (2013.01)

(58) Field of Classification Search

CPC .... F04B 2205/15; F04B 49/22; F04B 49/24; F04B 53/10; F04B 1/295; F04B 2027/1813; F04B 2027/1831; F04B 2027/1854; F04B 27/12; F04B 27/18; F04B 27/1804; F04B 27/1054; F04B 2027/1809; F04B 2027/185; F04C 14/24; F04C 2270/58; F04C 28/24; F04D 15/0005; F04D 15/02; F04D 27/009; F04D 27/0207

USPC ..... 417/222.1, 222.2, 269, 270; 62/498

See application file for complete search history.

(56) References Cited

U.S. PATENT DOCUMENTS 6,227,812 B1 * 5/2001 Kawaguchi ..... F04B 27/1804 417/222.2
6,382,926 B2 * 5/2002 Ota ..... F04B 27/1804 417/222.2

(Continued)

FOREIGN PATENT DOCUMENTS

JP 1-190972 A 8/1989
JP 2001-221158 A 8/2001

*Primary Examiner* — Dominick L Plakkoottam
(74) *Attorney, Agent, or Firm* — Sughrue Mion, PLLC

(57) ABSTRACT

A variable displacement swash plate type compressor includes a control valve having a valve body and a solenoid portion A refrigerant circuit has first and second pressure monitoring points. A load based on a point-to-point differential pressure, which is a differential pressure between the pressure at the first and second pressure monitoring points, is applied to the valve body. At least one of a load based on a DS differential pressure, which is a differential pressure between the pressure in a discharge pressure zone and the pressure in a suction pressure zone, and a load based on a CS differential pressure, which is a differential pressure between the pressure in the control pressure chamber and the pressure in the suction pressure zone, acts on the valve body in the same direction as the direction of the load applied to the valve body based on the point-to-point differential pressure.

7 Claims, 19 Drawing Sheets

(51) Int. Cl.

| | |
|---|---|
| ***F04B 27/10*** | (2006.01) |
| ***F04B 27/08*** | (2006.01) |
| ***F04B 1/29*** | (2006.01) |

(56) References Cited

U.S. PATENT DOCUMENTS 9,010,138 B2 * 4/2015 Yoshida ..... F04B 11/0091 417/213
9,228,576 B2 * 1/2016 Yamamoto ..... F04B 27/18
9,316,217 B2 * 4/2016 Yamamoto ..... F04B 27/1804
2005/0287014 A1 * 12/2005 Umemura ..... F04B 27/1804 417/222.1
2009/0220356 A1 * 9/2009 Yamamoto ..... F04B 27/1804 417/222.1
2009/0269216 A1 * 10/2009 Ota ..... F04B 27/1804 417/222.1
2012/0251343 A1 * 10/2012 Taguchi ..... F04B 27/1804 417/222.2
2013/0126017 A1 * 5/2013 Ota ..... F04B 27/1804 137/487.5

* cited by examiner

VARIABLE DISPLACEMENT SWASH PLATE TYPE COMPRESSOR

BACKGROUND OF THE INVENTION

The present invention relates to a variable displacement swash plate type compressor that constitutes part of, for example, a refrigerant circuit for a vehicle air conditioner and is configured to change the displacement by changing the pressure in a control pressure chamber to change the inclination angle of a swash plate.

A variable displacement swash plate type compressor has a bleed passage, which extends from a control pressure chamber to a suction pressure zone, and a supply passage, which extends from a discharge pressure zone to the control pressure chamber. A control valve controls the pressure in the control pressure chamber, so that the inclination angle of a swash plate is changed. This reciprocates pistons engaged with the swash plate by a stroke corresponding to the inclination angle of the swash plate, so that the displacement is changed. The control valve controls the amount of refrigerant gas to be supplied from a discharge pressure zone via the supply passage to the control pressure chamber by controlling the opening degree of the supply passage. Refrigerant gas is discharged from the control pressure chamber via the bleed passage to the suction pressure zone, so that the pressure in the control pressure chamber is controlled.

Such a variable displacement swash plate type compressor constitutes part of a refrigerant circuit (cooling circuit) for a vehicle air conditioner. The refrigerant circuit is provided with a variable displacement swash plate type compressor and an external refrigerant circuit. The external refrigerant circuit includes a condenser, an expansion valve, and an evaporator. A discharge chamber of the variable displacement swash plate type compressor and the inlet of the condenser are connected to each other via a discharge passage. The outlet of the evaporator and a suction chamber of the variable displacement swash plate type compressor are connected to each other via a suction passage. A restrictor, e.g., a fixed restrictor, is provided at the middle of the discharge passage. The restrictor lowers discharge pulsation of refrigerant gas.

In a vehicle, compressor driving torque required for driving a variable displacement swash plate type compressor, which uses the engine as a drive source, is estimated in order to suitably control the engine output. In general, the displacement is used as a parameter for estimating the compressor driving torque. Thereupon, a differential pressure is detected between a pressure (PdH) at a first pressure monitoring point, which is located on the upstream side of the restrictor in the discharge passage in the flow direction of refrigerant gas circulating through a refrigerant circuit, and a pressure (PdL) at a second pressure monitoring point, which is located on the downstream of the restrictor in the discharge passage. This differential pressure will be hereinafter referred to as "a point-to-point differential pressure". A control valve, which is provided with a differential pressure detecting means for applying a load based on the point-to-point differential pressure to a valve body, is disclosed in Japanese Laid-Open Patent Publication No. 2001-221158, for example.

The differential pressure detecting means is connected to and driven by a flow rate setting means. The flow rate setting means applies an urging force that counters the load applied to a valve body by the differential pressure detecting means based on a point-to-point differential pressure, and sets a target value of the flow rate of refrigerant in a refrigerant circuit in accordance with the urging force. The flow rate setting means is provided with an electric drive unit (solenoid portion), which is configured to change the urging force when being electrically controlled from outside. By electrically controlling the electric drive unit, the opening degree of the valve body is controlled in a state where there is equilibrium between the load applied to the valve body by the differential pressure detecting means based on the point-to-point differential pressure and the urging force applied to the valve body by the flow rate setting means to the valve body.

As the flow rate of refrigerant gas flowing through the restrictor becomes higher, the point-to-point differential pressure becomes larger. As the flow rate of refrigerant gas flowing through the restrictor becomes lower, the point-to-point differential pressure becomes smaller. Accordingly, the point-to-point differential pressure has a correlation with the flow rate of refrigerant gas flowing through a restrictor, i.e., the flow rate of refrigerant flowing in the refrigerant circuit. The flow rate of refrigerant gas flowing through the restrictor is equal to the displacement of the variable displacement swash plate type compressor. This enables determination of the displacement of the variable displacement swash plate type compressor, such as the compressor described in the above publication, provided with a control valve by directly measuring the supply amount of electricity to the solenoid portion, which is correlated to the displacement. Accordingly, it is possible to estimate the compressor driving torque using the displacement, without providing a flow rate sensor, for example, for detecting the flow rate of refrigerant gas.

In a variable displacement swash plate type compressor having single-headed pistons, a swash plate chamber functions as a control pressure chamber in order to change the inclination angle of the swash plate. A load based on the point-to-point differential pressure acts on a valve body and thus the opening degree by the valve body in a supply passage is maximized in a state where electricity supply to the solenoid portion is at a stop, for example. Accordingly, the supply amount of refrigerant gas from the discharge pressure zone via the supply passage to the swash plate chamber is maximized. This minimizes the inclination angle of the swash plate and thus minimizes the displacement of the variable displacement swash plate type compressor.

In contrast, when electricity is supplied to the solenoid portion, urging force applied to the valve body by the solenoid portion to the valve body acts on the valve body, and thus the opening degree by the valve body in the supply passage becomes larger than the maximum degree. Accordingly, the supply amount of refrigerant gas from the discharge pressure zone via the supply passage to the swash plate chamber is decreased, and thus the inclination angle of the swash plate is increased. Accordingly, the displacement of the variable displacement swash plate type compressor is increased.

The solid line in the graph of FIG. 20 is a characteristic line L1 illustrating the relationship between the point-to-point differential pressure generated by a restrictor having a certain passage cross-sectional area (restrictor diameter) and the flow rate of refrigerant gas. As illustrated in FIG. 20, the differential pressure between a first pressure monitoring point and a second pressure monitoring point via a restrictor is unlikely to be generated in a region where the flow rate of refrigerant gas is small. That is, fluctuation in the point-to-point differential pressure is small with respect to fluctuation in the flow rate of refrigerant gas. Accordingly, in a region where the flow rate of refrigerant gas is small, it is required to slightly change urging force applied to the valve body by the solenoid portion in the process of controlling the opening degree of the valve body by the solenoid portion. This makes it difficult to control the displacement of the variable displacement swash plate type compressor.

As the displacement increases, the pressure in the discharge pressure zone becomes higher. Accordingly, an increase in the displacement increases the differential pressure between the pressure in a discharge pressure zone and the pressure in a suction pressure zone (hereinafter referred to as "DS differential pressure"). That is, the DS differential pressure has a correlation with the flow rate of refrigerant gas. Especially in a variable displacement swash plate type compressor having single-headed pistons, fluctuation in the pressure in a swash plate chamber with respect to fluctuation in the displacement is approximate to fluctuation in the pressure in the suction pressure zone. This makes the differential pressure between the pressure in the discharge pressure zone and the pressure in the swash plate chamber (hereinafter referred to as "DC differential pressure") larger as the displacement increases. That is, the DC differential pressure has a correlation with the flow rate of refrigerant gas as well.

Thereupon, assume a case where a load based on the DC differential pressure is caused to act on the valve body in the same direction as the direction of the load applied to the valve body based on the point-to-point differential pressure, for example. In such a case, in the process of controlling the opening degree of a valve portion by the solenoid portion in a region where the flow rate of refrigerant gas is small, fluctuation in the flow rate of refrigerant gas with respect to fluctuation in the point-to-point differential pressure is unlikely to occur since the load based on the DC differential pressure acts on the valve body. As a result, fluctuation in the flow rate of refrigerant gas with respect to fluctuation in the point-to-point differential pressure becomes smaller in a region where the flow rate of refrigerant gas is small. This improves controllability of the displacement of the variable displacement swash plate type compressor in a zone where the flow rate of refrigerant gas is small.

In contrast, in a double-headed piston swash plate type compressor, a swash plate chamber cannot function as a control pressure chamber for changing the inclination angle of a swash plate as in a variable displacement swash plate type compressor having a single-headed piston. Thereupon, a compressor provided with an actuator that changes the inclination angle of a swash plate is disclosed in Japanese Laid-Open Patent Publication No. 1-190972, for example.

The actuator has a partition body, which is provided on a rotary shaft, a movable body, which moves in a swash plate chamber in a direction along the rotational axis of the rotary shaft, and a control pressure chamber, which is defined by the partition body and the movable body. The control pressure chamber moves the movable body by introducing refrigerant gas from the discharge pressure zone. Introduction of refrigerant gas into the control pressure chamber changes the internal pressure of the control pressure chamber and thus moves the movable body in the axial direction of the rotary shaft. As the movable body is moved along the axis of the rotary shaft, the inclination angle of the swash plate is changed.

Specifically, as the pressure in the control pressure chamber becomes higher and the pressure in the control pressure chamber approaches the pressure in the discharge pressure zone, the movable body moves toward an end of the rotary shaft in the axial direction. The movement of the movable body increases the inclination angle of the swash plate. As the pressure in the control pressure chamber becomes lower and the pressure in the control pressure chamber approaches the pressure in the suction pressure zone, the movable body moves toward the other end of the rotary shaft in the axial direction. The movement of the movable body decreases the inclination angle of the swash plate. As the inclination angle of the swash plate is reduced, the stroke of the double-headed pistons is reduced. Accordingly, the displacement is decreased. Therefore, as the inclination angle of the swash plate increases, the stroke of the double-headed piston becomes larger and the displacement increases.

In a variable displacement swash plate type compressor that uses an actuator for changing the inclination angle of a swash plate, the pressure in the control pressure chamber largely fluctuates between the pressure in the suction pressure zone and the pressure in the discharge pressure zone with fluctuation in the displacement as in the double-headed piston swash plate type compressor. That is, it is difficult to obtain a correlation of a differential pressure (DC differential pressure) between the pressure in the discharge pressure zone and the pressure in the control pressure chamber with fluctuation in the displacement. This makes it difficult to improve controllability of the displacement of the variable displacement swash plate type compressor in a region where the flow rate of refrigerant gas is small, even by causing the load of the DC differential pressure to act on the valve body as described above in the same direction as the direction of the load applied to the valve body based on the point-to-point differential pressure.

SUMMARY OF THE INVENTION

An objective of the present invention is to provide a variable displacement swash plate type compressor that improves controllability of the displacement.

To achieve the foregoing objective and in accordance with one aspect of the present invention, a variable displacement swash plate type compressor is provided that includes a housing, a rotary shaft, a swash plate, a piston, a movable body, a control pressure chamber, and a control valve. The housing has a suction pressure zone, a discharge pressure zone, and a cylinder bore. The rotary shaft is rotationally supported in the housing. The swash plate is accommodated in the housing and is rotated by drive force from the rotary shaft. An inclination angle of the swash plate is changeable with respect to the rotary shaft. The piston is engaged with the swash plate and reciprocates by a stroke corresponding to the inclination angle of the swash plate. The movable body is coupled to the swash plate and configured to change the inclination angle of the swash plate. The control pressure chamber moves the movable body in a direction in which a rotational axis of the rotary shaft extends as an internal pressure of the control pressure chamber changes, thereby changing the inclination angle of the swash plate. The control valve controls pressure in the control pressure chamber. The variable displacement swash plate type compressor constitutes part of a refrigerant circuit. The refrigerant circuit has a first pressure monitoring point, and a second pressure monitoring point, which is located on the downstream side of the first pressure monitoring point in the flow direction of refrigerant circulating through the refrigerant circuit. The control valve has a valve body and a solenoid portion. When a load based on a point-to-point differential pressure, which is a differential pressure between the pressure at the first pressure monitoring point and the pressure at the second pressure monitoring point, applied, the valve body moves in the same direction as the direction of the load, thereby decreasing the inclination angle of the swash plate. When receiving electricity supply, the solenoid portion applies urging force to counter the load applied to the valve body based on the point-to-point differential pressure to the valve body, thereby controlling the opening degree of the valve body. At least one of a load based on a DS differential pressure, which is a differential pressure between the pressure in the discharge pressure zone and the pressure in the suction pressure zone, and a load based on a CS differential pressure, which is a differential pressure between the pressure in the control pressure chamber and the pressure in the suction pressure zone, acts on the valve body in the same direction as the direction of the load applied to the valve body based on the point-to-point differential pressure.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A variable displacement swash plate type compressor according to a first embodiment will now be described with reference to FIGS. 1 to 5. The variable displacement swash plate type compressor is used in a vehicle air conditioner.

Figure 1:
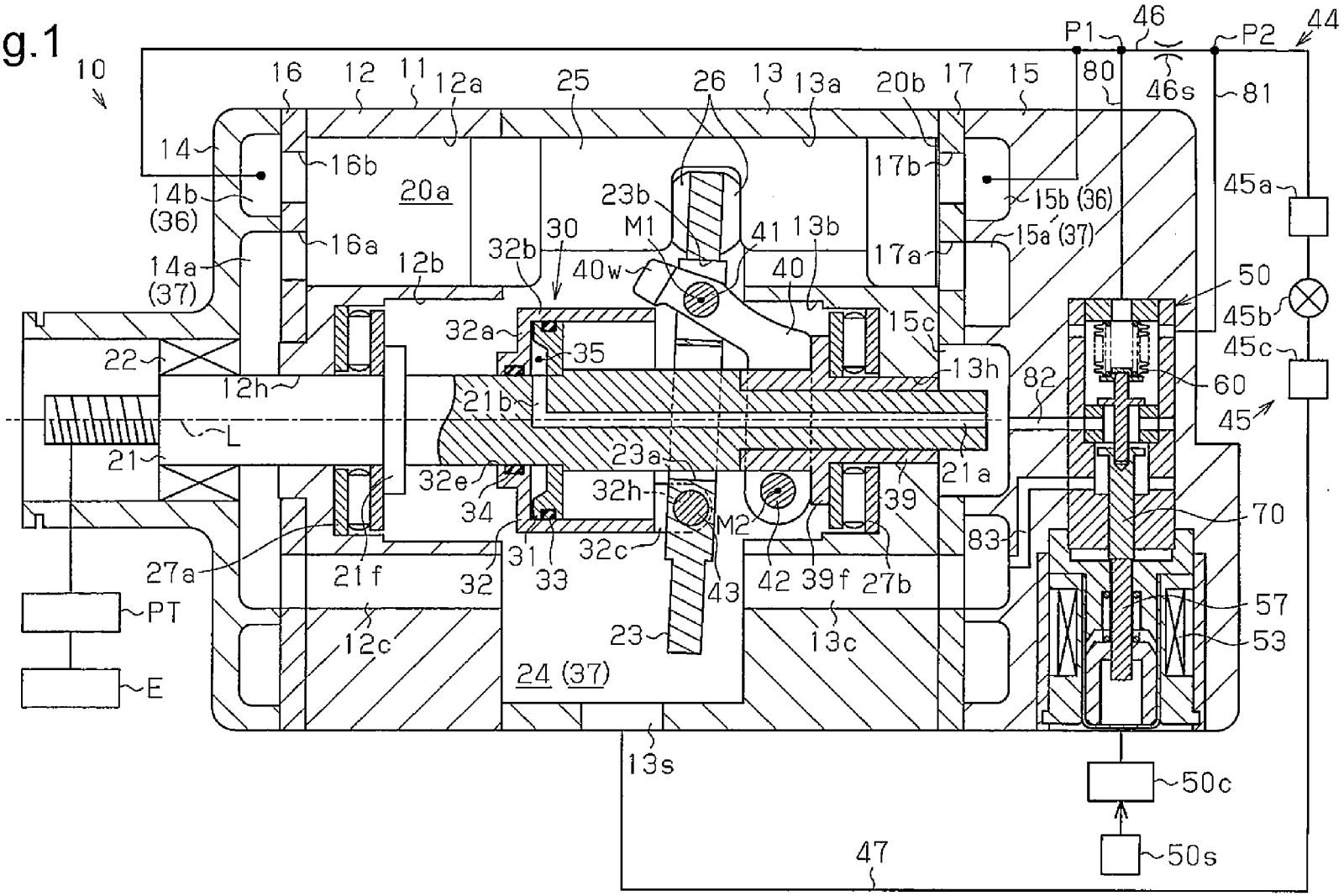
FIG. 1 is a cross-sectional side view illustrating a variable displacement swash plate type compressor according to a first embodiment.

As shown in FIG. 1, the compressor 10 includes a housing 11, which is formed by a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is formed in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chambers 14*b*, 15*b* are in a discharge pressure zone 36.

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing member 11. A part of the rotary shaft 21 on the front side (first side) extends through a shaft hole 12*h*, which is formed to extend through the first cylinder block 12. Specifically, the front part of the rotary shaft 21 refers to a part of the rotary shaft 21 that is located on the first side in the direction along the rotational axis L of the rotary shaft 21 (the axial direction of the rotary shaft 21). The front end of the rotary shaft 21 is located in the front housing member 14. A part of the rotary shaft 21 on the rear side (second side) extends through a shaft hole 13*h*, which is formed in the second cylinder block 13. Specifically, the rear part of the rotary shaft 21 refers to a part of the rotary shaft 21 that is located on the second side in the direction in which the rotational axis L of the rotary shaft 21 extends. The rear end of the rotary shaft 21 is located in the pressure adjusting chamber 15*c*.

The front part of the rotary shaft 21 is rotationally supported by the first cylinder block 12 at the shaft hole 12*h*. The rear part of the rotary shaft 21 is rotationally supported by the second cylinder block 13 at the shaft hole 13*h*. A sealing device 22 of lip seal type is located between the front housing member 14 and the rotary shaft 21. The front end of the rotary shaft 21 is connected to and driven by an external drive source, which is a vehicle engine E in this embodiment, through a power transmission mechanism PT. In this embodiment, the power transmission mechanism PT is a clutchless mechanism that constantly transmits power. The power transmission mechanism PT is constituted by combination of a belt and pulleys, for example.

In the housing 11, the first cylinder block 12 and the second cylinder block 13 define a swash plate chamber 24. A swash plate 23 is accommodated in the swash plate chamber 24. The swash plate 23 receives drive force from the rotary shaft 21 to be rotated. The swash plate 23 is also tiltable along the axis L of the rotary shaft 21 with respect to the rotary shaft 21. The swash plate 23 has an insertion hole 23*a*, through which the rotary shaft 21 extends. The swash plate 23 is assembled to the rotary shaft 21 by inserting the rotary shaft 21 into the insertion hole 23*a*.

The first cylinder block 12 has first cylinder bores 12*a* (only one of the first cylinder bores 12*a* is illustrated in FIG. 1), which extend along the axis of the first cylinder block 12 and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which extend along the axis of the second cylinder block 13 and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction. That is, the variable displacement swash plate type compressor 10 of the present embodiment is a double-headed piston swash plate type compressor.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. Accordingly, each pair of the shoes 26 serves as a conversion mechanism that reciprocates the corresponding double-headed piston 25 in a pair of the first cylinder bore 12*a* and the second cylinder bore 13*a* as the swash plate 23 rotates. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the swash plate chamber 24. The swash plate chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the swash plate chamber 24. The swash plate chamber 24 and the suction chamber 15*a* are connected to each other by a suction passage 13*c*, which extends through the second cylinder block 13 and the second valve plate 17. A suction inlet 13*s* is formed in the peripheral wall of the second cylinder block 13.

The variable displacement swash plate type compressor 10 constitutes part of a refrigerant circuit (cooling circuit) 44 for a vehicle air conditioner. The refrigerant circuit 44 is provided with the variable displacement swash plate type compressor 10 and an external refrigerant circuit 45. The external refrigerant circuit 45 is provided with a condenser 45*a*, an expansion valve 45*b*, and an evaporator 45*c*. Each of the discharge chambers 14*b* and 15*b* is connected to an inlet of the condenser 45*a* via a discharge passage 46. An outlet of the evaporator 45*c* is connected to the suction inlet 13*s* via a suction passage 47. A restrictor 46*s* is provided at the middle of the discharge passage 46. The restrictor 46*s* lowers discharge pulsation of refrigerant gas.

Refrigerant gas discharged to each of the discharge chambers 14*b* and 15*b* flows through the discharge passage 46, the external refrigerant circuit 45, and the suction passage 47 and is drawn from the suction inlet 13*s* to the swash plate chamber 24. Refrigerant gas drawn to the swash plate chamber 24 is drawn via the suction passages 12*c* and 13*c* to the suction chambers 14*a* and 15*a*. Accordingly, the suction chambers 14*a* and 15*a* and the swash plate chamber 24 are in a suction pressure zone 37. The suction chambers 14*a* and 15*a* and the swash plate chamber 24 have substantially equal pressures. The discharge passage 46 has a first pressure monitoring point P1, which is located on the upstream side of the restrictor 46*s* in the discharge passage 46, and a second pressure monitoring point P2, which is located on the downstream side of the restrictor 46*s* in the discharge passage 46, in the flow direction of refrigerant gas circulating through the refrigerant circuit 44.

The rotary shaft 21 has an annular flange portion 21*f*, which extends in the radial direction. The flange portion 21*f* is arranged in the first large diameter hole 12*b*. With respect to the axial direction of the rotary shaft 21, a first thrust bearing 27*a* is arranged between the flange portion 21*f* and the first cylinder block 12. A cylindrical supporting member 39 is press fitted to a rear portion of the rotary shaft 21. The supporting member 39 has an annular flange portion 39*f*, which extends in the radial direction. The flange portion 39*f* is arranged in the second large diameter hole 13*b*. With respect to the axial direction of the rotary shaft 21, a second thrust bearing 27*b* is arranged between the flange portion 39*f* and the second cylinder block 13.

The swash plate chamber 24 accommodates an actuator 30, which changes the inclination angle of the swash plate 23. The inclination angle of the swash plate 23 is changed with respect to a direction perpendicular to the rotational axis L of the rotary shaft 21. The actuator 30 is provided on the rotary shaft 21 between the flange portion 21*f* and the swash plate 23. The actuator 30 has an annular partition body 31, which rotates integrally with the rotary shaft 21. Moreover, the actuator 30 is provided with a cylindrical movable body 32 having a closed end. The movable body 32 is placed between the flange portion 21*f* and the partition body 31. The movable body 32 moves in the swash plate chamber 24 in the axial direction of the rotary shaft 21.

The movable body 32 is formed by an annular bottom portion 32*a* and a cylindrical portion 32*b*. An insertion hole 32*e* is formed in the bottom portion 32*a* to receive the rotary shaft 21. The cylindrical portion 32*b* extends along the axis of the rotary shaft 21 from the peripheral edge of the bottom portion 32*a*. The inner circumferential surface of the cylindrical portion 32*b* is slidable along the outer circumferential surface of the partition body 31. This allows the movable body 32 to rotate integrally with the rotary shaft 21 via the partition body 31. The clearance between the inner circumferential surface of the cylindrical portion 32*b* and the outer circumferential surface of the partition body 31 is sealed by a sealing member 33. The clearance between the insertion hole 32*e* and the rotary shaft 21 is sealed by a sealing member 34. The actuator 30 has a control pressure chamber 35, which is defined by the partition body 31 and the movable body 32.

A first in-shaft passage 21*a* is formed in the rotary shaft 21. The first in-shaft passage 21*a* extends along the axis L of the rotary shaft 21. The rear end of the first in-shaft passage 21*a* is opened to the interior of the pressure adjusting chamber 15*c*. A second in-shaft passage 21*b* is formed in the rotary shaft 21. The second in-shaft passage 21*b* extends in the radial direction of the rotary shaft 21. One end of the second in-shaft passage 21*b* communicates with the first in-shaft passage 21*a*. The other end of the second in-shaft passage 21*b* is opened to the interior of the control pressure chamber 35. Accordingly, the control pressure chamber 35 and the pressure adjusting chamber 15*c* are connected to each other by the first in-shaft passage 21*a* and the second in-shaft passage 21*b*.

In the swash plate chamber 24, a lug arm 40, which is a link mechanism for allowing change in the inclination angle of the swash plate 23, is arranged between the swash plate 23 and the flange portion 39*f*. The lug arm 40 has a substantially L shape extending in the vertical direction of FIG. 1. The lug arm 40 has a weight portion 40*w* formed at one end (upper end). The weight portion 40*w* is passed through a groove 23*b* of the swash plate 23 to be located to a position in front of the swash plate 23.

The upper portion of the lug arm 40 is coupled to the upper portion (as viewed in FIG. 1) of the swash plate 23 by a columnar first pin 41, which extends across the groove 23*b*. This structure allows the upper portion of the lug arm 40 to be supported by the swash plate 23 such that the upper portion of the lug arm 40 pivots about a first pivot axis M1, which coincides with the axis of the first pin 41. A lower portion of the lug arm 40 is coupled to the supporting member 39 by a columnar second pin 42. This structure allows the lower portion of the lug arm 40 to be supported by the supporting member 39 such that the lower portion of the lug arm 40 pivots about a second pivot axis M2, which coincides with the axis of the second pin 42.

As shown in FIG. 1, a coupling portion 32*c* is formed at the distal end of the cylindrical portion 32*b* of the movable body 32. The coupling portion 32*c* protrudes toward the swash plate 23. The coupling portion 32*c* has an insertion hole 32*h* for receiving a columnar coupling pin 43. The coupling pin 43 is press fitted and fixed to the lower portion of the swash plate 23. The coupling portion 32*c* is coupled to the lower portion of the swash plate 23 via the coupling pin 43.

The pressure in the control pressure chamber 35 is controlled by introducing refrigerant gas from the discharge chamber 15*b* to the control pressure chamber 35 and discharging refrigerant gas from the control pressure chamber 35 to the suction chamber 15*a*. Thus, the refrigerant gas introduced into the control pressure chamber 35 serves as control gas for controlling the pressure in the control pressure chamber 35. The pressure difference between the control pressure chamber 35 and the swash plate chamber 24 causes the movable body 32 to move along the axis of the rotary shaft 21 with respect to the partition body 31. An electromagnetic control valve 50 for controlling the pressure in the control pressure chamber 35 is installed in the rear housing member 15. The control valve 50 is electrically connected to a control computer 50*c*. Signaling connection is provided between the control computer 50*c* and an air conditioner switch 50*s*.

Figure 2:
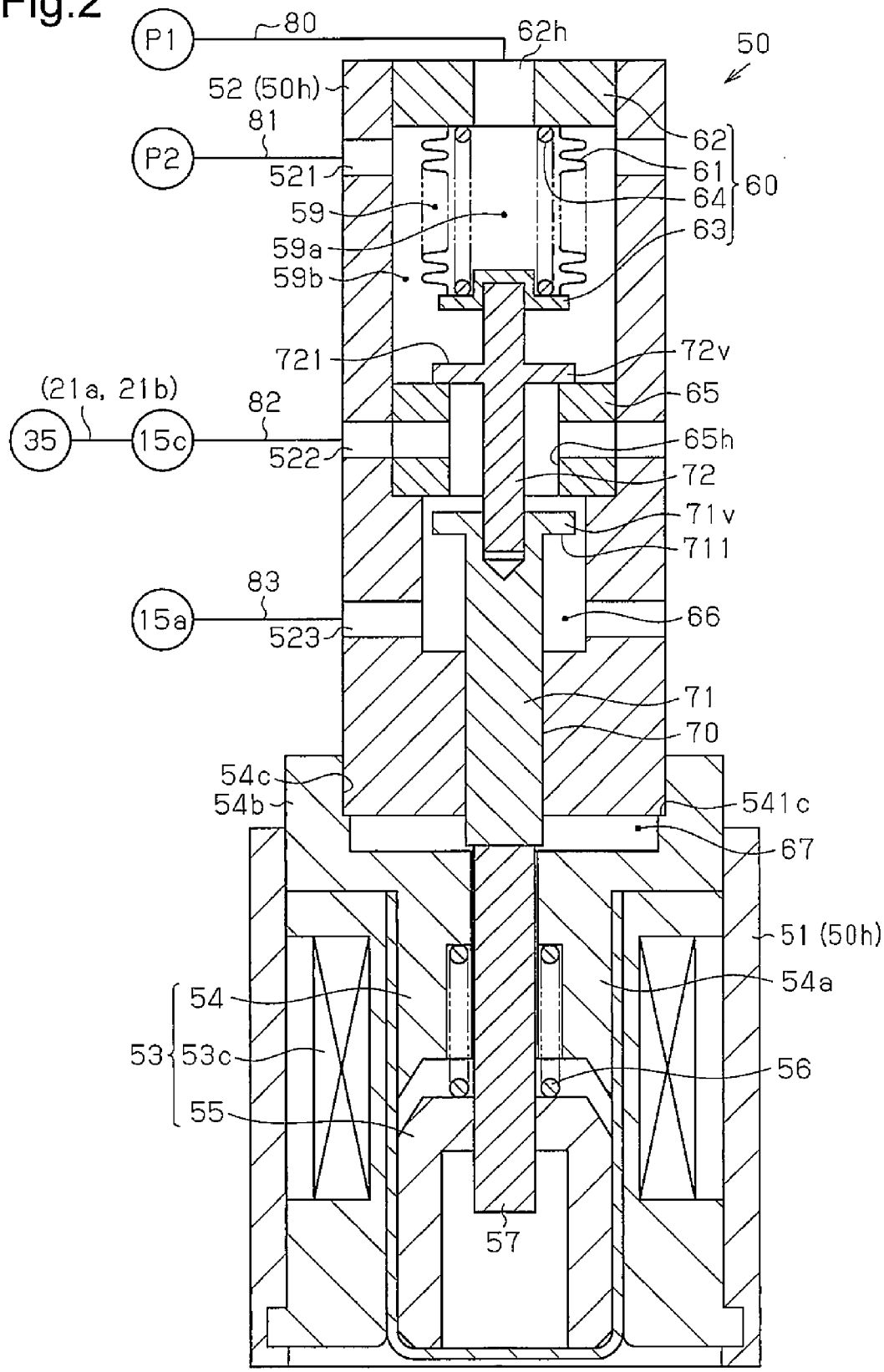
FIG. 2 is a cross-sectional view of a control valve when the swash plate is at the minimum inclination angle.

As illustrated in FIG. 2, the control valve 50 has a valve housing 50*h*. The valve housing 50*h* has a tubular first housing 51 for accommodating a solenoid portion 53, and a tubular second housing 52 installed in the first housing 51. The solenoid portion 53 has a fixed iron core 54 and a movable iron core 55. The movable iron core 55 is attracted to the fixed iron core 54 based on excitation caused by current supply to a coil 53*c*. The electromagnetic force of the solenoid portion 53 attracts the movable iron core 55 toward the fixed iron core 54. The solenoid portion 53 is subjected to current control (duty cycle control) performed by the control computer 50*c*. A spring 56 is located between the fixed iron core 54 and the movable iron core 55. The spring 56 urges the movable iron core 55 away from the fixed iron core 54.

A drive force transmitting rod 57 is attached to the movable iron core 55. The drive force transmitting rod 57 is allowed to move integrally with the movable iron core 55. The fixed iron core 54 is composed of a small diameter portion 54*a*, which is placed inside the coil 53*c*, and a large diameter portion 54*b* having a diameter larger than the small diameter portion 54*a*. The large diameter portion 54*b* projects from an opening of the first housing 51 on the opposite side from the movable iron core 55. A recess 54*c* is formed on the end face of the large diameter portion 54*b* on the opposite side from the small diameter portion 54*a*. A step portion 541 is formed on the inner wall of the recess 54*c*. The second housing 52 is fitted and fixed to the recess 54*c* while being in contact with the step portion 541*c*.

An accommodation chamber 59 is formed in the second housing 52 on the opposite side from the solenoid portion 53. A pressure sensing mechanism 60 is accommodated in the accommodation chamber 59. The pressure sensing mechanism 60 is composed of bellows 61, a press-fitted body 62, a coupling body 63 and a spring 64. The press-fitted body 62 is coupled to an end of the bellows 61 and press fitted to an opening of the second housing 52 on the opposite side from the first housing 51. The coupling body 63 is coupled to the other end of the bellows 61. The spring 64 urges the press-fitted body 62 and the coupling body 63 away from each other in the bellows 61.

An annular valve seat member 65 is press fitted and fixed to a bottom portion of the accommodation chamber 59 close to the solenoid portion 53. A valve hole 65*h* is formed at the center of the valve seat member 65. A communicating chamber 66 is formed at a portion in the second housing 52 closer to the solenoid portion 53 than the valve seat member 65. The accommodation chamber 59 and the communicating chamber 66 communicate with each other via the valve hole 65*h*. A back pressure chamber 67 is defined between the recess 54*c* and the end face of the second housing 52 facing the solenoid portion 53.

The second housing 52 accommodates a columnar valve body 70 extending from the back pressure chamber 67 to the accommodation chamber 59. The valve body 70 is composed of a first valve body member 71 and a second valve body member 72. The first valve body member 71 extends from the back pressure chamber 67 to the communicating chamber 66. The second valve body member 72 is coupled to the end face of the first valve body member 71 facing the valve seat member 65. Moreover, the second valve body member 72 projects through the valve hole 65*h* into the accommodation chamber 59. The first valve body member 71 has a first valve portion 71*v* as an annular valve portion. The first valve portion 71*v* contacts the circumference of the valve hole 65*h* on the end face of the valve seat member 65 facing the solenoid portion 53. The second valve body member 72 has a second valve portion 72*v* as an annular valve portion. The second valve portion 72*v* contacts the circumference of the valve hole 65*h* on the end face of the valve seat member 65 facing the pressure sensing mechanism 60. The first valve portion 71*v* and the second valve portion 72*v* have the same outer diameter. An end portion of the second valve body member 72 accommodated in the accommodation chamber 59 is connected to and driven by the coupling body 63.

The drive force transmitting rod 57 extends through the fixed iron core 54 and projects into the back pressure chamber 67. An end portion of the drive force transmitting rod 57 in the vicinity of the back pressure chamber 67 is in contact with the first valve body member 71.

The second housing 52 has a communicating hole 521, which communicates with the accommodation chamber 59. Moreover, a communicating hole 522, which communicates with the valve hole 65*h*, is formed in the second housing 52 and the valve seat member 65. Furthermore, a communicating hole 523, which communicates with the communicating chamber 66, is formed in the second housing 52. Moreover, the press-fitted body 62 has a communicating hole 62*h*, which communicates with the inside of the bellows 61. The inside of the bellows 61 is connected to the first pressure monitoring point P1 via the communicating hole 62*h* and a passage 80. The accommodation chamber 59 is connected to the second pressure monitoring point P2 via the communicating hole 521 and a passage 81. Accordingly, the bellows 61 functions as a partition member for partitioning the accommodation chamber 59 into a first introduction chamber 59*a* for introducing the pressure at the first pressure monitoring point P1 and a second introduction chamber 59*b* for introducing the pressure at the second pressure monitoring point P2.

Moreover, the valve hole 65*h* communicates with the pressure adjusting chamber 15*c* via the communicating hole 522 and a passage 82. Accordingly, the passage 81, the communicating hole 521, the accommodation chamber 59, the valve hole 65*h*, the communicating hole 522, the passage 82, the pressure adjusting chamber 15*c*, the first in-shaft passage 21*a*, and the second in-shaft passage 21*b* form a supply passage extending from the second pressure monitoring point P2 to the control pressure chamber 35.

The communicating chamber 66 communicates with the suction chamber 15*a* through the communicating hole 523 and a passage 83. Accordingly, the second in-shaft passage 21*b*, the first in-shaft passage 21*a*, the pressure adjusting chamber 15*c*, the passage 82, the communicating hole 522, the valve hole 65*h*, the communicating chamber 66, the communicating hole 523, and the passage 83 form a bleed passage extending from the control pressure chamber 35 to the suction chamber 15*a*.

The pressure sensing mechanism 60 is extended or contracted in accordance with a point-to-point differential pressure, which is a differential pressure between the pressure (PdH) at the first pressure monitoring point P1 and the pressure (PdL) at the second pressure monitoring point P2. The extension or contraction of the pressure sensing mechanism 60 controls the pressure in the control pressure chamber 35 so that the displacement changes in a direction cancelling out fluctuation in the point-to-point differential pressure. A load based on the point-to-point differential pressure is applied to the valve body 70 toward the solenoid portion 53. The load based on the point-to-point differential pressure moves the valve body 70 toward the solenoid portion 53.

When the first valve portion 71*v* contacts the circumference of the valve hole 65*h* on the end face of the valve seat member 65 facing the solenoid portion 53, the first valve portion 71*v* is put into a closed state to close the bleed passage. In contrast, when the first valve portion 71*v* moves away from the end face of the valve seat member 65 facing the solenoid portion 53, the first valve portion 71*v* is put into an open state to open the bleed passage. When the second valve portion 72*v* contacts the circumference of the valve hole 65*h* on the end face of the valve seat member 65 facing the pressure sensing mechanism 60, the second valve portion 72*v* is put into a closed to close the supply passage. In contrast, when the second valve portion 72*v* moves away from the end face of the valve seat member 65 facing the pressure sensing mechanism 60, the second valve portion 72*v* is put into an open state to open the supply passage.

Regarding the variable displacement swash plate type compressor 10 having the above structure, in a state where the air conditioner switch 50*s* is turned off and electricity supply to the solenoid portion 53 is at a stop, the force of the spring 56 moves the movable iron core 55 away from the fixed iron core 54. A load based on the point-to-point differential pressure acts toward the solenoid portion 53, and thus the valve body 70 moves toward the solenoid portion 53. This moves the first valve portion 71*v* from the end face of the valve seat member 65 facing the solenoid portion 53 and causes the second valve portion 72*v* to contact the circumference of the valve hole 65*h* on the end face of the valve seat member 65 facing the pressure sensing mechanism 60.

An increase in the opening degree of the first valve portion 71*v* increases the flow rate of refrigerant gas discharged from the control pressure chamber 35 via the second in-shaft passage 21*b*, the first in-shaft passage 21*a*, the pressure adjusting chamber 15*c*, the passage 82, the communicating hole 522, the valve hole 65*h*, the communicating chamber 66, the communicating hole 523 and the passage 83 to the suction chamber 15*a*. Therefore, the pressure in the control pressure chamber 35 approaches the pressure in the suction chamber 15*a*.

As illustrated in FIG. 1, when the pressure in the control pressure chamber 35 approaches the pressure in the suction chamber 15*a* and a pressure difference between the control pressure chamber 35 and the swash plate chamber 24 becomes smaller, compression reaction force from the double-headed pistons 25 acts on the swash plate 23 and thus causes the swash plate 23 to pull the movable body 32. This moves the movable body 32 so that the bottom portion 32*a* of the movable body 32 approaches the partition body 31. This causes the swash plate 23 to pivot about the first pivot axis M1. As the swash plate 23 pivots about the first pivot axis M1, the ends of the lug arm 40 pivot about the first pivot axis M1 and the second pivot axis M2, respectively. The lug arm 40 thus approaches the flange portion 39*f* of the supporting member 39. This reduces the inclination angle of the swash plate 23 and thus reduces the stroke of the double-headed pistons 25. Accordingly, the displacement is decreased. The lug arm 40 contacts the flange portion 39*f* of the supporting member 39 when the swash plate 23 reaches the minimum inclination angle. The contact between the lug arm 40 and the flange portion 39*f* maintains the minimum inclination angle of the swash plate 23.

Figure 3:
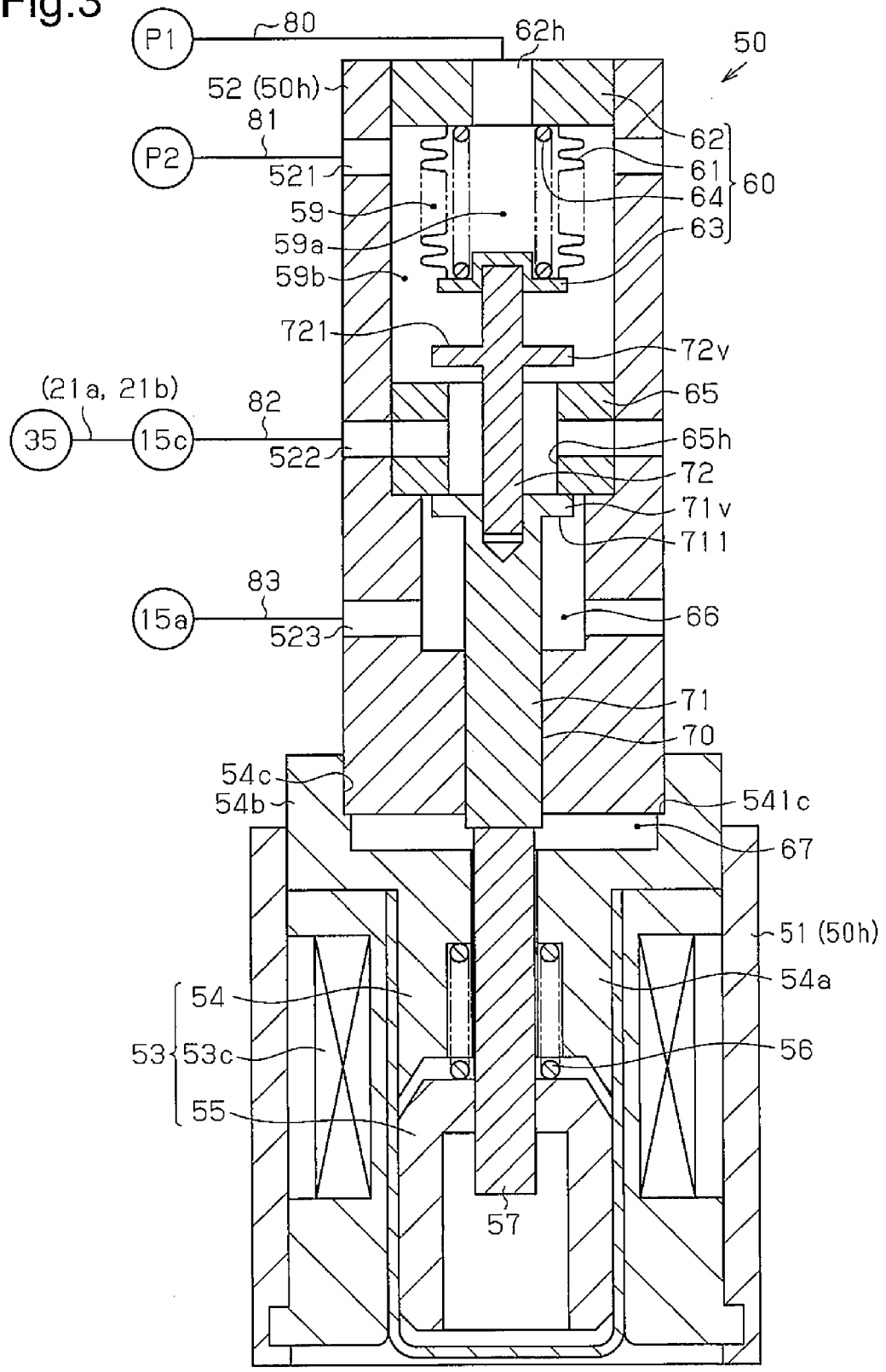
FIG. 3 is a cross-sectional view of the control valve when the swash plate is at the maximum inclination angle.

As illustrated in FIG. 3, in the variable displacement swash plate type compressor 10 having the above structure, electricity is supplied to the solenoid portion 53 when the air conditioner switch 50*s* is turned on. Electromagnetic force of the solenoid portion 53 attracts the movable iron core 55 toward the fixed iron core 54 against the force of the spring 56. Then, the drive force transmitting rod 57 presses the valve body 70. When the valve body 70 is pressed, the opening degree of the first valve portion 71*v* decreases, and the second valve portion 72*v* moves away from the end face of the valve seat member 65 facing the pressure sensing mechanism 60. Accordingly, when receiving electricity supply, the solenoid portion 53 applies urging force to counter a load applied to the valve body 70 based on the point-to-point differential pressure to the valve body 70.

This reduces the flow rate of refrigerant gas that is discharged from the control pressure chamber 35 to the suction chamber 15*a* via the second in-shaft passage 21*b*, the first in-shaft passage 21*a*, the pressure adjusting chamber 15*c*, the passage 82, the communicating hole 522, the valve hole 65*h*, the communicating chamber 66, the communicating hole 523, and the passage 83. Refrigerant gas is supplied to the control pressure chamber 35 from the second pressure monitoring point P2 via the passage 81, the communicating hole 521, the accommodation chamber 59, the valve hole 65*h*, the communicating hole 522, the passage 82, the pressure adjusting chamber 15*c*, the first in-shaft passage 21*a* and the second in-shaft passage 21*b*. Therefore, the pressure in the control pressure chamber 35 approaches the pressure in the discharge chamber 15*b*.

Figure 4:
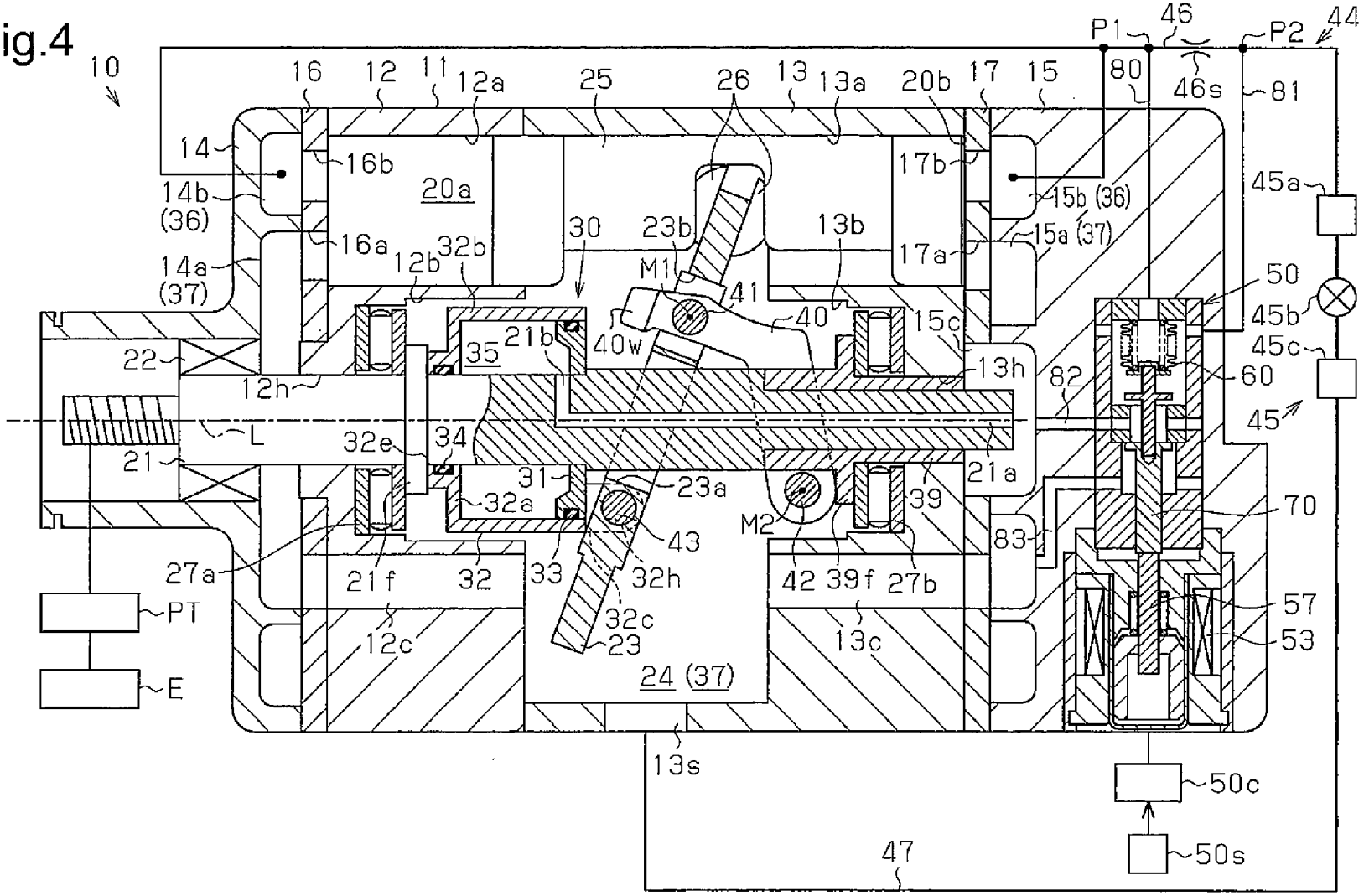
FIG. 4 is a cross-sectional side view illustrating the variable displacement swash plate type compressor when the swash plate is at the maximum inclination angle.

As illustrated in FIG. 4, when the pressure in the control pressure chamber 35 approaches the pressure in the discharge chamber 15*b* and a pressure difference between the control pressure chamber 35 and the swash plate chamber 24 becomes larger, the movable body 32 pulls the swash plate 23. This moves the movable body 32 so that the bottom portion 32*a* of the movable body 32 moves away from the partition body 31. This causes the swash plate 23 to pivot about the first pivot axis M1 in a direction opposite to the pivoting direction for decreasing the inclination angle of the swash plate 23. As the swash plate 23 pivots about the first pivot axis M1 in a direction opposite to the inclination angle decreasing direction, the ends of the lug arm 40 pivot about the first pivot axis M1 and the second pivot axis M2, respectively, in a direction opposite to the pivoting direction for decreasing the inclination angle of the swash plate 23. The lug arm 40 thus moves away from the flange portion 39*f* of the supporting member 39. This increases the inclination angle of the swash plate 23 and thus increases the stroke of the double-headed pistons 25. Accordingly, the displacement is increased. The movable body 32 contacts the flange portion 21*f* when the swash plate 23 reaches the maximum inclination angle. The contact between the movable body 32 and the flange portion 21*f* maintains the maximum inclination angle of the swash plate 23.

As illustrated in FIGS. 2 and 3, the pressure in the communicating chamber 66, i.e., the pressure in the suction chamber 15*a* acts on a working surface 711 of the first valve portion 71*v* in the valve body 70 on the opposite side from the valve seat member 65. Moreover, the pressure in the accommodation chamber 59, i.e., the pressure at the second pressure monitoring point P2 acts on a working surface 721 of the second valve portion 72*v* on the opposite side from the valve seat member 65. The end face of the first valve portion 71*v* facing the valve seat member 65 and the end face of the second valve portion 72*v* facing the valve seat member 65 have the same pressure receiving area.

Operation of the first embodiment will now be described.

The pressure in the suction chamber 15*a* acts on the working surface 711 of the first valve portion 71*v* on the opposite side from the valve seat member 65. Moreover, the pressure at the second pressure monitoring point P2 acts on the working surface 721 of the second valve portion 72*v* on the opposite side from the valve seat member 65. Accordingly, a load based on a DS differential pressure which is a differential pressure between the pressure at the second pressure monitoring point P2 and the pressure in the suction chamber 15*a* acts on the valve body 70 in the same direction as the direction of the load applied to the valve body 70 based on the point-to-point differential pressure.

Figure 5:
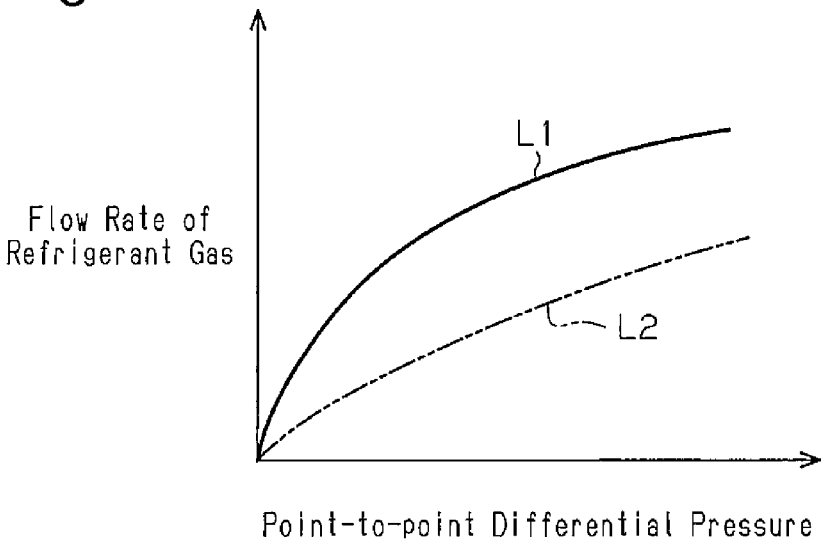
FIG. 5 is a graph illustrating the relationship between a point-to-point differential pressure and the flow rate of refrigerant gas.

The solid line in the graph of FIG. 5 is a characteristic line L1 illustrating the relationship between the point-to-point differential pressure and the flow rate of refrigerant gas flowing through the restrictor 46*s*, i.e., the flow rate of refrigerant gas flowing in the refrigerant circuit 44. The characteristic line L1 is obtained in a case where a load based on the DS differential pressure does not act on the valve body 70 in the same direction as the direction of the load applied to the valve body 70 based on the point-to-point differential pressure. The characteristic line L1 is a comparison example for the first embodiment. The double dot-dashed line in the graph of FIG. 5 is a characteristic line L2 illustrating the relationship between the point-to-point differential pressure and the flow rate of refrigerant gas. The characteristic line L2 is obtained in a case where a load based on the DS differential pressure acts on the valve body 70 in the same direction as the direction of the load applied to the valve body 70 based on the point-to-point differential pressure.

The pressure at the second pressure monitoring point P2 becomes higher as the displacement increases. Accordingly, as the displacement increases, the DS differential pressure becomes larger. That is, the DS differential pressure has a correlation with the flow rate of refrigerant gas. The characteristic lines L1 and L2 are compared with each other regarding a region where the flow rate of refrigerant gas is small. As a result of comparison, in the process of controlling the opening degree of the first valve portion 71*v* and the second valve portion 72*v* by the solenoid portion 53, a load based on the DS differential pressure acts in the same direction as the direction of the load applied to the valve body 70 based on the point-to-point differential pressure, and thus fluctuation in the flow rate of refrigerant gas with respect to fluctuation in the point-to-point differential pressure is unlikely to occur. As a result, fluctuation in the flow rate of refrigerant gas with respect to fluctuation in the point-to-point differential pressure becomes smaller in a region where the flow rate of refrigerant gas is small, and thus controllability of the displacement of the variable displacement swash plate type compressor 10 is improved in a zone where the flow rate of refrigerant gas is small.

The first embodiment achieves the following advantages.

(1) The load based on the DS differential pressure acts on the valve body 70 in the same direction as the direction of the load applied to the valve body 70 based on the point-to-point differential pressure. The DS differential pressure has a correlation with the flow rate of refrigerant gas flowing through the restrictor 46*s*. Accordingly, in the process of controlling the opening degree of the first valve portion 71*v* and the second valve portion 72*v* by the solenoid portion 53, a load based on the DS differential pressure acts in the same direction as the direction of the load applied to the valve body 70 based on the point-to-point differential pressure in a zone where the flow rate of refrigerant gas is small, and thus fluctuation in the flow rate of refrigerant gas with respect to fluctuation in the point-to-point differential pressure is unlikely to occur. As a result, fluctuation in the flow rate of refrigerant gas with respect to fluctuation in the point-to-point differential pressure becomes smaller in a region where the flow rate of refrigerant gas is small. This improves controllability of the displacement of the variable displacement swash plate type compressor 10 in a zone where the flow rate of refrigerant gas is small.

(2) In a double-headed piston swash plate type compressor, in which double-headed pistons 25 are employed, the swash plate chamber 24 cannot function as a control pressure chamber for changing the inclination angle of the swash plate 23 as in a variable displacement swash plate type compressor having a single-headed piston. Thereupon, the inclination angle of the swash plate 23 is increased by heightening the internal pressure of the control pressure chamber 35, and the inclination angle of the swash plate 23 is decreased by lowering the internal pressure of the control pressure chamber 35 in this embodiment. Since the control pressure chamber 35 is a space smaller than the swash plate chamber 24, the amount of refrigerant gas introduced into the control pressure chamber 35 becomes smaller, and thus satisfactory responsiveness to change in the inclination angle of the swash plate 23 is obtained.

Second Embodiment

A variable displacement swash plate type compressor according to a second embodiment will now be described with reference to FIG. 6. In the embodiments described below, the same reference numerals are given to those components that are the same as the corresponding components of the first embodiment, which has already been described, and explanations are omitted or simplified.

Figure 6:
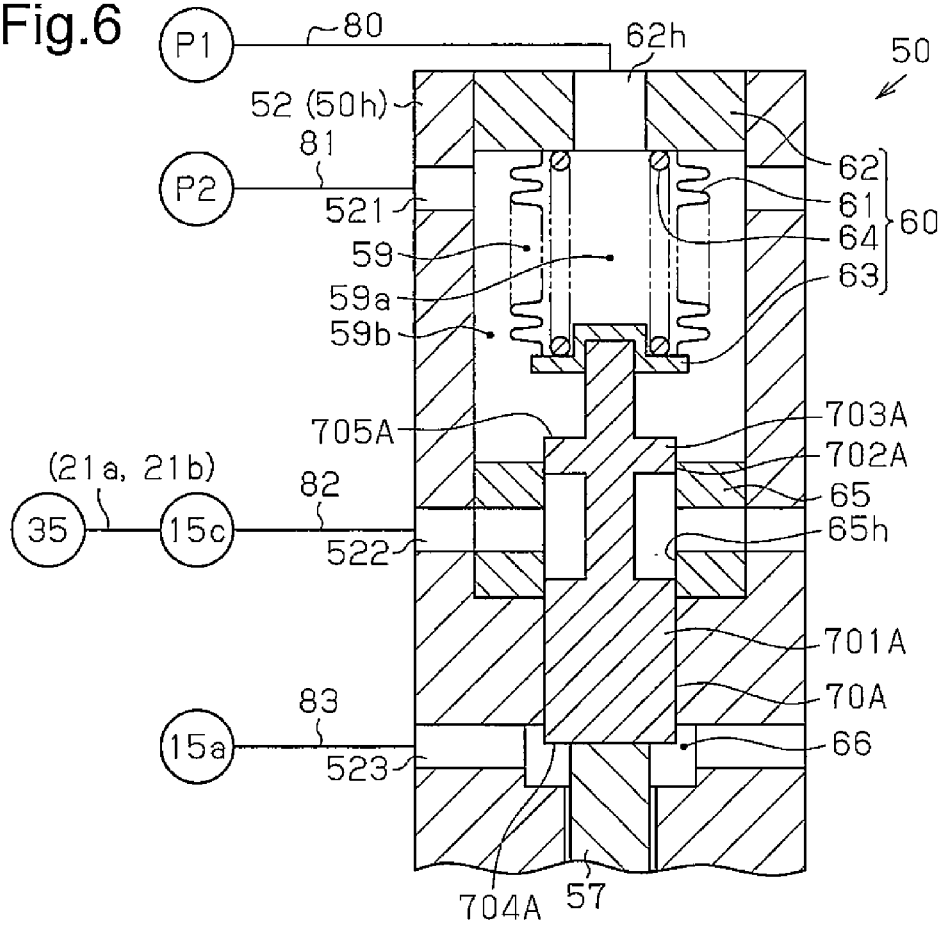
FIG. 6 is a partial cross-sectional view showing a control valve according to a second embodiment.

As illustrated in FIG. 6, the second housing 52 accommodates a columnar valve body 70A extending from the communicating chamber 66 to the accommodation chamber 59. The valve body 70A is provided with a sealing portion 701A and an annular valve portion 703A. The sealing portion 701A seals the boundary between the communicating chamber 66 and the valve hole 65*h*. The valve portion 703A has an outer surface sealing portion 702A, which enters the valve hole 65*h* to seal the boundary between the valve hole 65*h* and the accommodation chamber 59. The sealing portion 701A and the valve portion 703A have the same outer diameter. The drive force transmitting rod 57 projects into the communicating chamber 66. An end portion of the drive force transmitting rod 57 facing the communicating chamber 66 is in contact with the sealing portion 701A. A bleed passage (unillustrated), which connects the control pressure chamber 35 and the suction chamber 15*a* with each other and has a restrictor, is additionally provided in the second embodiment outside the control valve 50 in the variable displacement swash plate type compressor 10.

When the air conditioner switch 50*s* is turned off, electricity supply to the solenoid portion 53 is stopped. In such a state, the load based on the point-to-point differential pressure acts toward the solenoid portion 53, and thus the valve body 70A moves toward the solenoid portion 53. This causes the valve portion 703A to enter the valve hole 65*h* and causes the outer surface sealing portion 702A to seal the boundary between the valve hole 65*h* and the accommodation chamber 59. Accordingly, the valve portion 703A is put into a closed state to close the supply passage. Refrigerant gas is discharged from the control pressure chamber 35 via the bleed passage to the suction chamber 15*a*, and thus the pressure in the control pressure chamber 35 approaches the pressure in the suction chamber 15*a*, and the inclination angle of the swash plate 23 becomes smaller. Accordingly, the stroke of the double-headed pistons 25 becomes smaller, and the displacement decreases.

When the air conditioner switch 50*s* is turned on, electricity is supplied to the solenoid portion 53. Then, the solenoid portion 53 applies to the valve body 70A an urging force that counters the load applied to the valve body 70A based on the point-to-point differential pressure. The valve body 70A moves toward the pressure sensing mechanism 60, and the valve portion 703A exits the valve hole 65*h*, so that the valve hole 65*h* and the accommodation chamber 59 communicate with each other. Accordingly, the valve portion 703A is put into an open state to open the supply passage. This supplies the pressure at the second pressure monitoring point P2 via the supply passage to the control pressure chamber 35. Therefore, the pressure in the control pressure chamber 35 approaches the pressure in the discharge chamber 15*b*, and the inclination angle of the swash plate 23 becomes larger. As a result, the stroke of the double-headed pistons 25 becomes larger, and thus the displacement increases.

The pressure in the communicating chamber 66, i.e., the pressure in the suction chamber 15*a* acts on a working surface 704A of the sealing portion 701A on the opposite side from the valve seat member 65. Moreover, the pressure in the accommodation chamber 59, i.e., the pressure at the second pressure monitoring point P2 acts on a working surface 705A of the valve portion 703A on the opposite side from the valve seat member 65. The end face of the sealing portion 701A facing the valve seat member 65 and the end face of the valve portion 703A facing the valve seat member 65 have the same pressure receiving area.

Operation of the second embodiment will now be described.

The pressure in the suction chamber 15*a* acts on the working surface 704A of the sealing portion 701A on the opposite side from the valve seat member 65. Moreover, the pressure at the second pressure monitoring point P2 acts on the working surface 705A of the valve portion 703A on the opposite side from the valve seat member 65. Accordingly, a load based on a DS differential pressure which is a differential pressure between the pressure at the second pressure monitoring point P2 and the pressure in the suction chamber 15*a* acts on the valve body 70A in the same direction as the direction of the load applied to the valve body 70A based on the point-to-point differential pressure. Accordingly, fluctuation in the flow rate of refrigerant gas with respect to fluctuation in the point-to-point differential pressure becomes smaller in a region where the flow rate of refrigerant gas is small as in the first embodiment. This improves controllability of the displacement of the variable displacement swash plate type compressor 10 in a zone where the flow rate of refrigerant gas is small.

Therefore, in addition to advantages equivalent to the advantages (1) and (2) of the first embodiment, the second embodiment achieves the following advantage.

(3) The valve body 70A has a valve portion 703A for opening and closing the supply passage. The valve body 70A in the second embodiment does not have a valve portion for opening and closing the bleed passage. This simplifies the structure of the valve body 70A.

Third Embodiment

A variable displacement swash plate type compressor according to a third embodiment will now be described with reference to FIG. 7.

Figure 7:
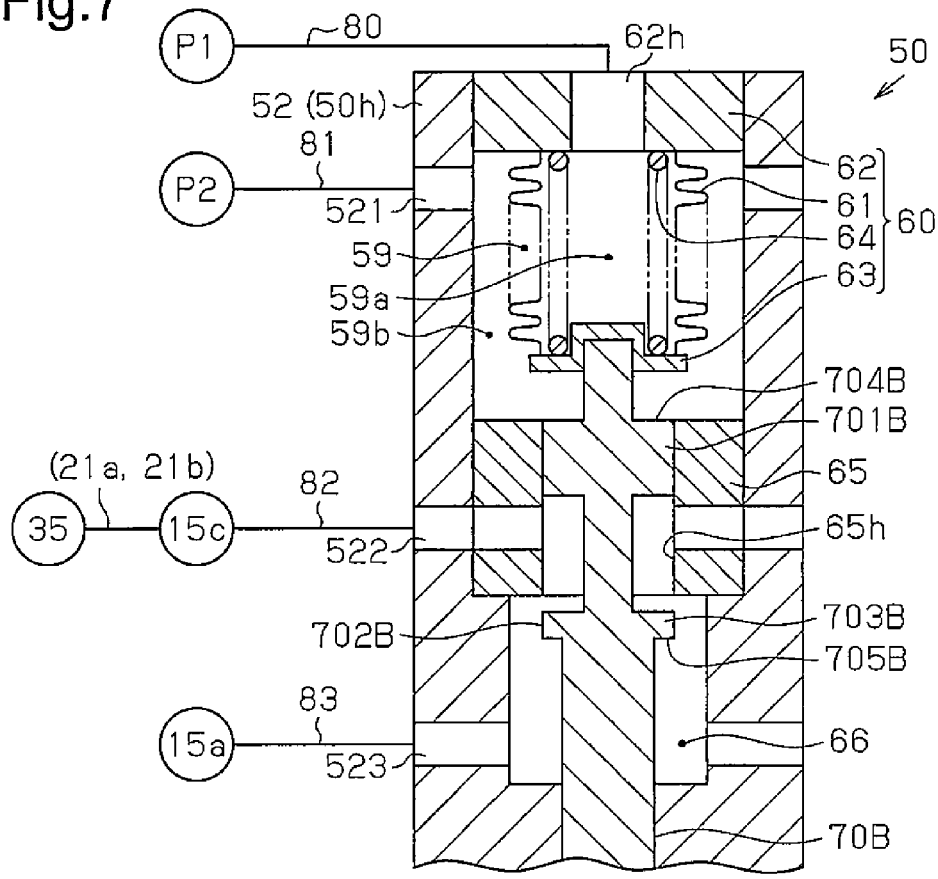
FIG. 7 is a partial cross-sectional view showing a control valve according to a third embodiment.

As illustrated in FIG. 7, the second housing 52 accommodates a columnar valve body 70B extending from the back pressure chamber 67 to the accommodation chamber 59. The valve body 70B is provided with a sealing portion 701B and an annular valve portion 703B. The sealing portion 701B seals the boundary between the valve hole 65*h* and the accommodation chamber 59. The valve portion 703B has an outer surface sealing portion 702B, which enters the valve hole 65*h* to seal the boundary between the valve hole 65*h* and the communicating chamber 66. The sealing portion 701B and the valve portion 703B have the same outer diameter. A supply passage (unillustrated) that connects the discharge chamber 15*b* and the control pressure chamber 35 with each other and has a restrictor is additionally provided in the third embodiment outside the control valve 50 of the variable displacement swash plate type compressor 10.

When the air conditioner switch 50*s* is turned off, electricity supply to the solenoid portion 53 is stopped. In such a state, the load based on the point-to-point differential pressure acts toward the solenoid portion 53, and thus the valve body 70B moves toward the solenoid portion 53. This causes the valve portion 703B to exit the valve hole 65*h*, so that the valve hole 65*h* and the communicating chamber 66 communicate with each other. Accordingly, the valve portion 703B is put into an open state to open the bleed passage. Refrigerant gas is discharged from the control pressure chamber 35 via the bleed passage to the suction chamber 15*a*, and thus the pressure in the control pressure chamber 35 approaches the pressure in the suction chamber 15*a*. This reduces the inclination angle of the swash plate 23 and thus reduces the stroke of the double-headed pistons 25. Accordingly, the displacement is decreased.

When the air conditioner switch 50*s* is turned on, electricity is supplied to the solenoid portion 53. Then, the solenoid portion 53 applies to the valve body 70B an urging force that counters the load applied to the valve body 70B based on the point-to-point differential pressure. This moves the valve body 70B toward the pressure sensing mechanism 60, and causes the valve portion 703B to enter the valve hole 65*h*. Then, the outer surface sealing portion 702B seals the boundary between the valve hole 65*h* and the communicating chamber 66. Accordingly, the valve portion 703B is put into a closed state to close the bleed passage. This supplies the pressure at the second pressure monitoring point P2 via the supply passage to the control pressure chamber 35, and thus the pressure in the control pressure chamber 35 approaches the pressure in the discharge chamber 15*b*. As a result, the inclination angle of the swash plate 23 becomes larger, and the stroke of the double-headed pistons 25 becomes larger. Accordingly, the displacement increases.

The pressure in the accommodation chamber 59, i.e., the pressure at the second pressure monitoring point P2 acts on a working surface 704B of the sealing portion 701B in the valve body 70B facing the pressure sensing mechanism 60. Moreover, the pressure in the communicating chamber 66, i.e., the pressure in the suction chamber 15*a* acts on a working surface 705B of the valve portion 703B facing the solenoid portion 53. The end face of the sealing portion 701B on the opposite side from the pressure sensing mechanism 60 and the end face of the valve portion 703B on the opposite side from the solenoid portion 53 have the same pressure receiving area.

Operation of the third embodiment will now be described.

The pressure at the second pressure monitoring point P2 acts on the working surface 704B of the sealing portion 701B facing the pressure sensing mechanism 60. Moreover, the pressure in the suction chamber 15*a* acts on the working surface 705B of the valve portion 703B facing the solenoid portion 53. Accordingly, the load based on a DS differential pressure which is a differential pressure between the pressure at the second pressure monitoring point P2 and the pressure in the suction chamber 15*a* acts on the valve body 70B in the same direction as the direction of the load applied to the valve body 70B based on the point-to-point differential pressure. Accordingly, fluctuation in the flow rate of refrigerant gas with respect to fluctuation in the point-to-point differential pressure becomes smaller in a region where the flow rate of refrigerant gas is small as in the first embodiment. This improves controllability of the displacement of the variable displacement swash plate type compressor 10 in a zone where the flow rate of refrigerant gas is small.

Therefore, in addition to advantages equivalent to the advantages (1) and (2) of the first embodiment, the third embodiment achieves the following advantage.

(4) The valve body 70B has a valve portion 703B for opening and closing the bleed passage. The valve body 70B in the third embodiment does not have a valve portion for opening and closing the supply passage. This simplifies the structure of the valve body 70B.

Fourth Embodiment

A variable displacement swash plate type compressor according to a fourth embodiment will now be described with reference to FIG. 8.

Figure 8:
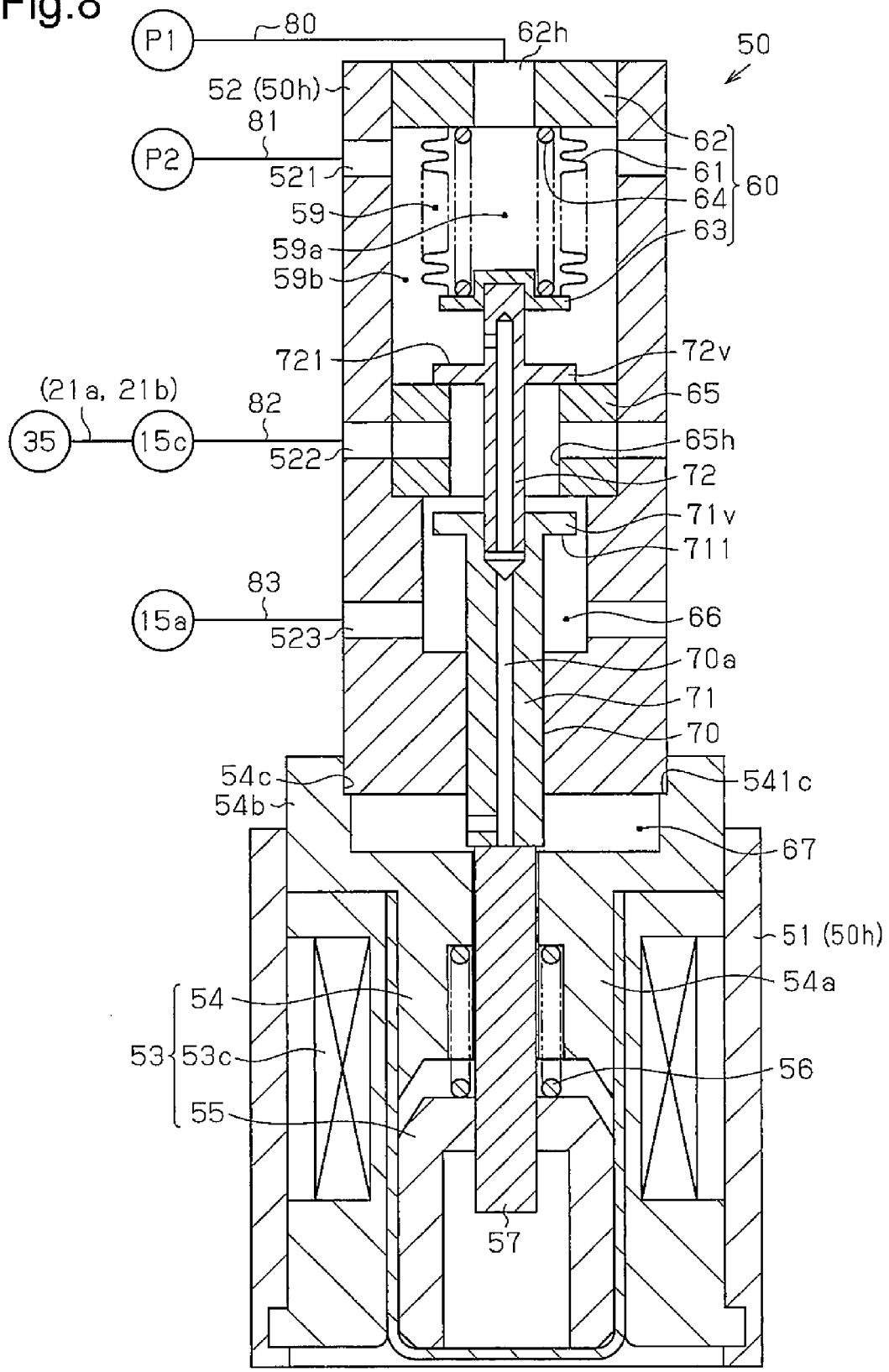
FIG. 8 is a cross-sectional view showing a control valve according to a fourth embodiment.

As illustrated in FIG. 8, the valve body 70 has an in-shaft passage 70*a* for connecting the second introduction chamber 59*b* of the accommodation chamber 59 and the back pressure chamber 67 with each other. Accordingly, the control valve 50 has the back pressure chamber 67, to which the pressure at the second pressure monitoring point P2 is introduced via the in-shaft passage 70*a* from the second introduction chamber 59*b*, on the opposite side of the valve body 70 from the accommodation chamber 59.

Operation of the fourth embodiment will now be described.

The pressure in the back pressure chamber 67, i.e., the pressure at the second pressure monitoring point P2 acts on the end face of the first valve body member 71 in the valve body 70 facing the solenoid portion 53. Accordingly, the pressure at the second pressure monitoring point P2, which acts on the valve body 70 in the second introduction chamber 59*b*, and the pressure at the second pressure monitoring point P2, which acts on the valve body 70 in the back pressure chamber 67, cancel out by the amount corresponding to a zone that overlaps in the axial direction of the valve body 70.

Therefore, in addition to advantages equivalent to the advantages (1) and (2) of the first embodiment, the fourth embodiment achieves the following advantage.

(5) The bellows 61 partitions the accommodation chamber 59 into the first introduction chamber 59*a* for introducing the pressure at the first pressure monitoring point P1 and the second introduction chamber 59*b* for introducing the pressure at the second pressure monitoring point P2. Furthermore, the back pressure chamber 67 for introducing the pressure at the second pressure monitoring point P2 is formed in the valve housing 50*h* on the opposite side of the valve body 70 from the accommodation chamber 59. With such a structure, the pressure at the second pressure monitoring point P2, which acts on the valve body 70 in the second introduction chamber 59*b*, and the pressure at the second pressure monitoring point P2, which acts on the valve body 70 in the back pressure chamber 67, cancel out. This reduces the urging force applied to the valve body 70 by the solenoid portion 53 by the amount by which the pressure at the second pressure monitoring point P2 cancels out. As a result, it is possible to reduce the size of the solenoid portion 53.

Fifth Embodiment

A variable displacement swash plate type compressor according to a fifth embodiment will now be described with reference to FIG. 9.

Figure 9:
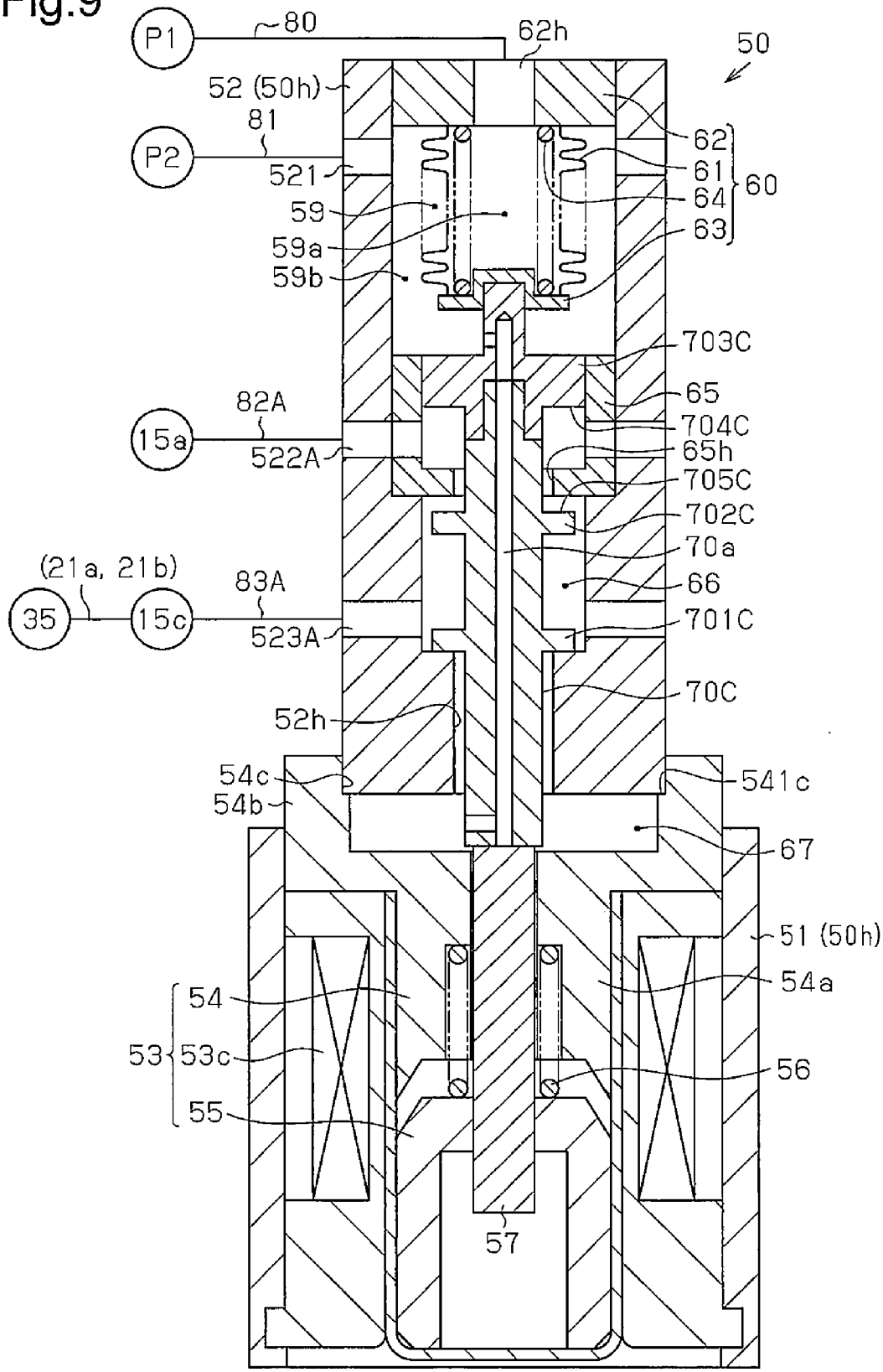
FIG. 9 is a cross-sectional view showing a control valve according to a fifth embodiment.

As illustrated in FIG. 9, the valve body 70C has an in-shaft passage 70*a* for connecting the second introduction chamber 59*b* of the accommodation chamber 59 and the back pressure chamber 67 with each other. Accordingly, the pressure in the second introduction chamber 59*b* is introduced via the in-shaft passage 70*a* to the back pressure chamber 67.

The valve hole 65*h* communicates with the suction chamber 15*a* via the communicating hole 522A, which extends through the second housing 52 and the valve seat member 65, and the passage 82A. Moreover, the communicating chamber 66 communicates with the pressure adjusting chamber 15*c* via the communicating hole 523A, which extends through the second housing 52, and the passage 83A. Accordingly, the second in-shaft passage 21*b*, the first in-shaft passage 21*a*, the pressure adjusting chamber 15*c*, the passage 83A, the communicating hole 523A, the valve hole 65*h*, the communicating hole 522A, and the passage 82A form a bleed passage extending from the control pressure chamber 35 to the suction chamber 15*a*.

The communicating chamber 66 and the back pressure chamber 67 communicate with each other via an insertion hole 52*h*. The insertion hole 52*h* extends through a bottom portion of the second housing 52. The valve body 70C is received in the insertion hole 52*h*. Accordingly, the passage 81, the communicating hole 521, the accommodation chamber 59, the in-shaft passage 70*a*, the back pressure chamber 67, the insertion hole 52*h*, the communicating chamber 66, the communicating hole 523A, the passage 83A, the pressure adjusting chamber 15*c*, the first in-shaft passage 21*a*, and the second in-shaft passage 21*b* form a supply passage extending from the second pressure monitoring point P2 to the control pressure chamber 35.

The valve body 70C has a first valve portion 701C as an annular valve portion in the communicating chamber 66. The first valve portion 701C contacts the circumference of the insertion hole 52*h* on a bottom surface facing the solenoid portion 53. Moreover, the valve body 70C has a second valve portion 702C as an annular valve portion in the communicating chamber 66. The second valve portion 702C contacts the circumference of the valve hole 65*h* on the end face of the valve seat member 65 facing the communicating chamber 66. The first valve portion 701C and the second valve portion 702C have the same outer diameter. Furthermore, the valve body 70C is coupled to a sealing portion 703C for sealing the boundary between the valve hole 65*h* and the accommodation chamber 59. The outer diameter of the sealing portion 703C is larger than the outer diameter of the first valve portion 701C and the second valve portion 702C. The end face of the first valve portion 701C on the opposite side from the solenoid portion 53 and the end face of the second valve portion 702C on the opposite side from the valve hole 65*h* have the same pressure receiving area.

Operation of the fifth embodiment will now be described.

The pressure in the back pressure chamber 67, i.e., the pressure at the second pressure monitoring point P2 acts on the end face of the valve body 70C facing the solenoid portion 53. Accordingly, the pressure at the second pressure monitoring point P2, which acts on the sealing portion 703C of the valve body 70C in the second introduction chamber 59*b*, and the pressure at the second pressure monitoring point P2, which acts on the valve body 70C in the back pressure chamber 67, cancel out by the amount corresponding to a zone that overlaps in the axial direction of the valve body 70C.

Moreover, between a working surface 704C of the sealing portion 703C facing the valve hole 65*h* and the end face 705C of the second valve portion 702C facing the valve hole 65*h*, the pressure in the valve hole 65*h*, i.e., the pressure in the suction chamber 15*a* acts on the working surface 704C of the sealing portion 703C facing the valve hole 65*h* by the amount by which the outer diameter of the sealing portion 703C is larger. Accordingly, the load based on the DS differential pressure, which is the differential pressure between the pressure at the second pressure monitoring point P2 (pressure in the discharge pressure zone 36) and the pressure in the suction chamber 15*a*, acts on the valve body 70C in the same direction as the direction of the load applied to the valve body 70C based on the point-to-point differential pressure.

Therefore, the fifth embodiment achieves advantages equivalent to the advantages (1), (2) of the first embodiment and the advantage (5) of the fourth embodiment.

Sixth Embodiment

A variable displacement swash plate type compressor according to a sixth embodiment will now be described with reference to FIG. 10.

Figure 10:
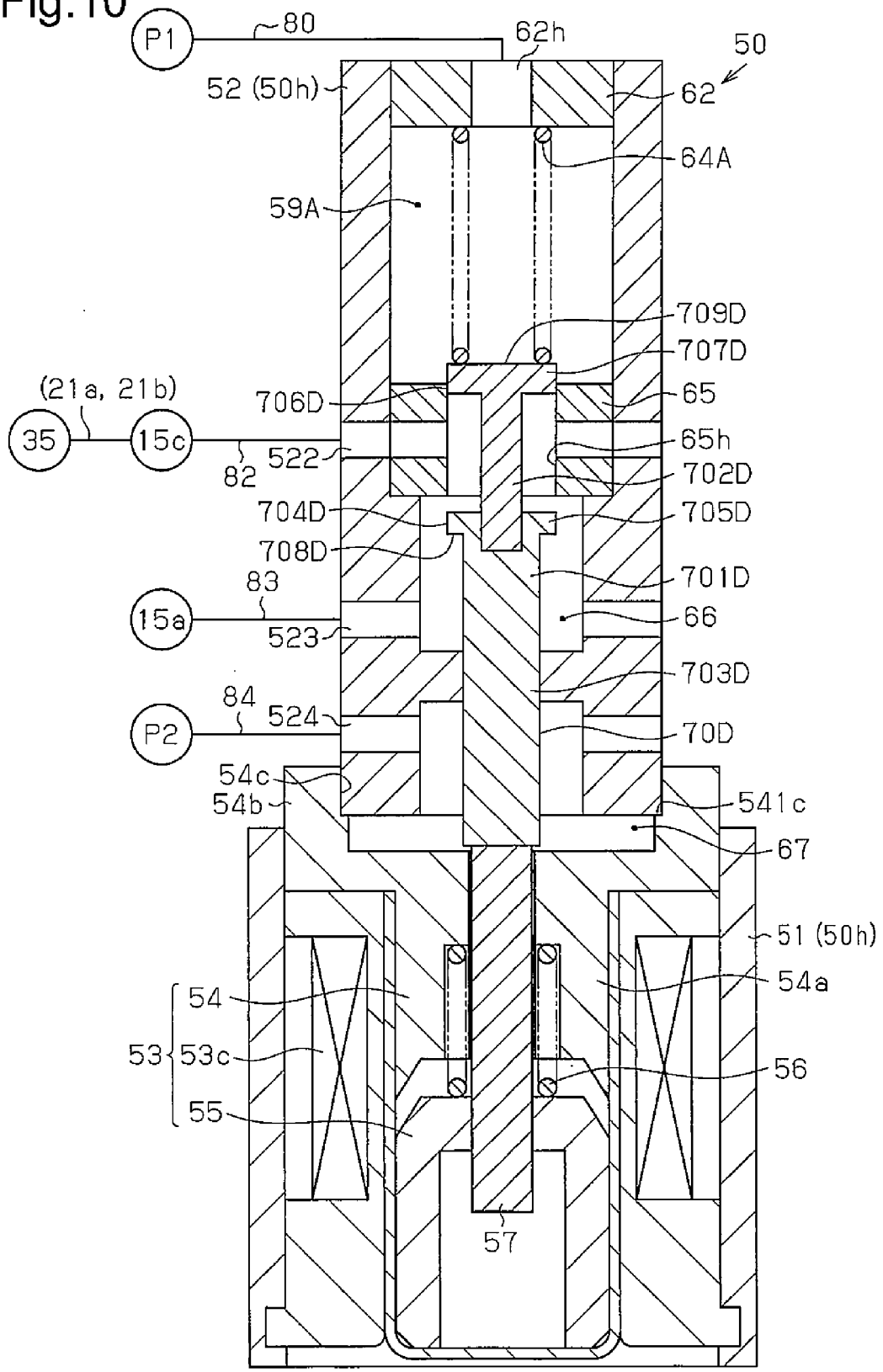
FIG. 10 is a cross-sectional view showing a control valve according to a sixth embodiment.

As illustrated in FIG. 10, an introduction chamber 59A for introducing the pressure at the first pressure monitoring point P1 is formed in the second housing 52 on the opposite side from the solenoid portion 53. The introduction chamber 59A accommodates a spring 64A for urging a valve body 70D toward the solenoid portion 53. The second housing 52 has a communicating hole 524, which communicates with the back pressure chamber 67. The back pressure chamber 67 is connected to the second pressure monitoring point P2 via the communicating hole 524 and a passage 84. Accordingly, the pressure at the second pressure monitoring point P2 is introduced via the passage 84 and the communicating hole 524 to the back pressure chamber 67.

The valve body 70D is composed of a first valve body member 701D and a second valve body member 702D. The first valve body member 701D extends from the back pressure chamber 67 to the communicating chamber 66. The second valve body member 702D is coupled to the end face of the first valve body member 701D facing the valve seat member 65 and projects through the valve hole 65*h* into the introduction chamber 59A. The first valve body member 701D is provided with a sealing portion 703D and an annular first valve portion 705D as a valve portion. The sealing portion 703D seals the boundary between the back pressure chamber 67 and the communicating chamber 66. The first valve portion 705D has an outer surface sealing portion 704D, which enters the valve hole 65*h* to seal the boundary between the communicating chamber 66 and the valve hole 65*h*. The second valve body member 702D is provided with an annular second valve portion 707D as a valve portion. The second valve portion 707D has an outer surface sealing portion 706D, which enters the valve hole 65*h* to seal the boundary between the valve hole 65*h* and the introduction chamber 59A. The first valve portion 705D and the second valve portion 707D have the same outer diameter.

The pressure in the communicating chamber 66, i.e., the pressure in the suction chamber 15*a* acts on a working surface 708D of the first valve portion 705D in the valve body 70D on the opposite side from the valve seat member 65. Moreover, the pressure in the introduction chamber 59A, i.e., the pressure at the first pressure monitoring point P1 acts on a working surface 709D of the second valve portion 707D facing the introduction chamber 59A. The end face of the first valve portion 705D facing the valve seat member 65 and the end face of the second valve portion 707D facing the valve seat member 65 have the same pressure receiving area.

Furthermore, the pressure in the back pressure chamber 67, i.e., the pressure at the second pressure monitoring point P2 acts on the end face of the valve body 70D in the vicinity of the back pressure chamber 67. Accordingly, the pressure at the first pressure monitoring point P1 acts on the working surface 709D of the second valve portion 707D facing the introduction chamber 59A and the pressure at the second pressure monitoring point P2 acts on the end face of the valve body 70D in the vicinity of the back pressure chamber 67. This applies the load based on the point-to-point differential pressure to the valve body 70D toward the solenoid portion 53.

Operation of the sixth embodiment will now be described.

The pressure in the suction chamber 15*a* acts on the working surface 708D of the first valve portion 705D on the opposite side from the valve seat member 65. Moreover, the pressure at the first pressure monitoring point P1 acts on the working surface 709D of the second valve portion 707D on the side corresponding to the introduction chamber 59A. Accordingly, the load based on a DS differential pressure which is a differential pressure between the pressure at the first pressure monitoring point P1 and the pressure in the suction chamber 15*a* acts on the valve body 70D in the same direction as the direction of the load applied to the valve body 70D based on the point-to-point differential pressure. Accordingly, fluctuation in the flow rate of refrigerant gas with respect to fluctuation in the point-to-point differential pressure becomes smaller in a region where the flow rate of refrigerant gas is small as in the first embodiment, and this improves controllability of the displacement of the variable displacement swash plate type compressor 10 in a zone where the flow rate of refrigerant gas is small.

Therefore, in addition to advantages equivalent to the advantages (1) and (2) of the first embodiment, the sixth embodiment achieves the following advantage.

(6) An introduction chamber 59A for introducing the pressure at the first pressure monitoring point P1, and a back pressure chamber 67, which is located on the opposite side of the valve body 70 from the introduction chamber 59A, for introducing the pressure at the second pressure monitoring point P2 are formed in the valve housing 50*h*. With such a structure, it is unnecessary to partition an accommodation chamber for accommodating a partition member into a first introduction chamber to which the pressure at the first pressure monitoring point P1 is introduced and a second introduction chamber to which the pressure at the second pressure monitoring point P2 is introduced with the partition member which is connected to and driven by the valve body 70D in order to generate a load to be applied to the valve body 70D based on the point-to-point differential pressure. Accordingly, it is possible to omit a partition member and thus simplify the structure of the control valve 50.

Seventh Embodiment

A variable displacement swash plate type compressor according to a seventh embodiment will now be described with reference to FIG. 11.

Figure 11:
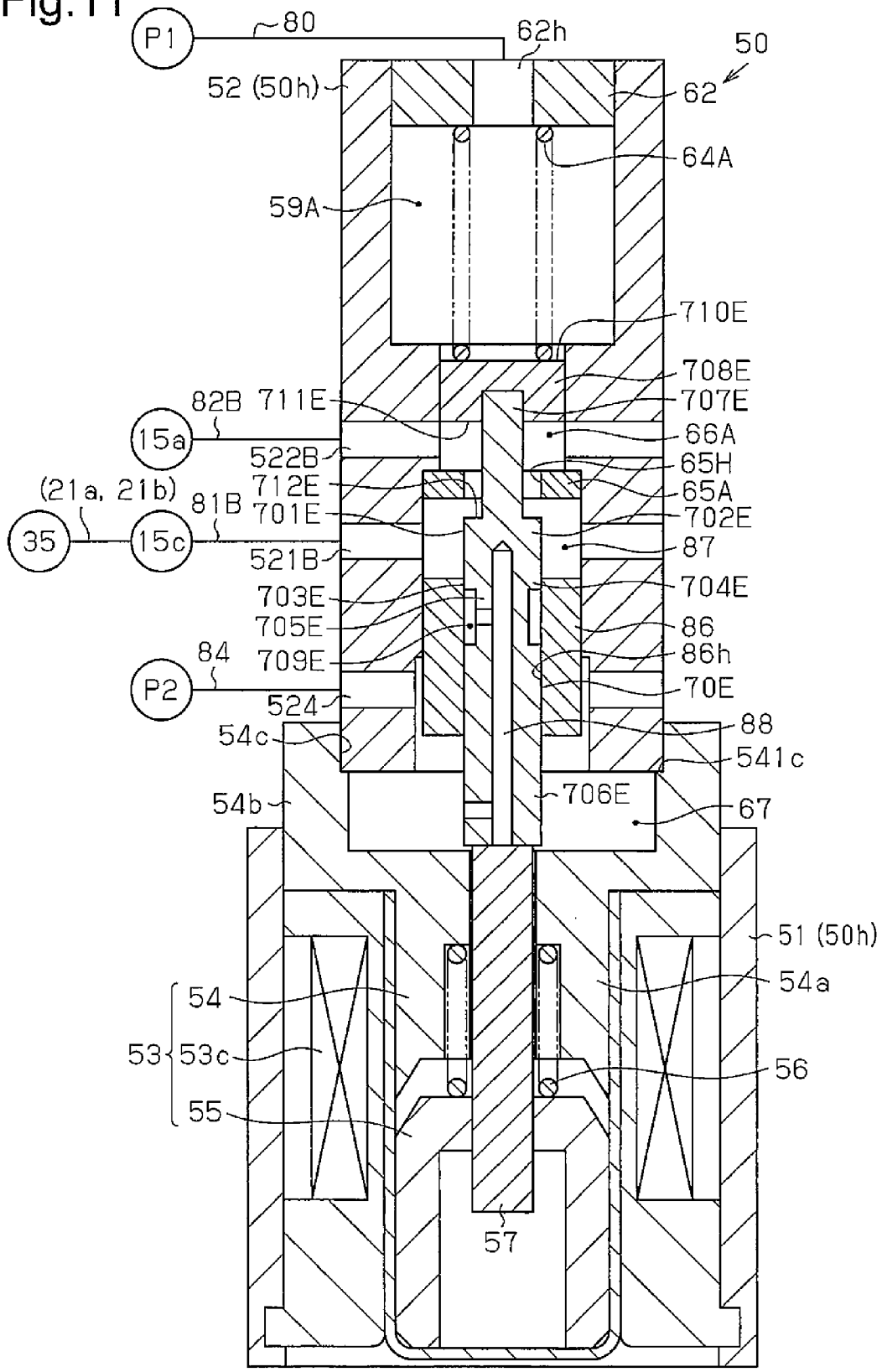
FIG. 11 is a cross-sectional view showing a control valve according to a seventh embodiment.

As illustrated in FIG. 11, the introduction chamber 59A for introducing the pressure at the first pressure monitoring point P1 is formed in the second housing 52 on the opposite side from the solenoid portion 53. The introduction chamber 59A accommodates the spring 64A, which urges a valve body 70E toward the solenoid portion 53. The second housing 52 has the communicating hole 524, which communicates with the back pressure chamber 67. The back pressure chamber 67 is connected to the second pressure monitoring point P2 via the communicating hole 524 and the passage 84. Accordingly, the pressure at the second pressure monitoring point P2 is introduced via the passage 84 and the communicating hole 524 to the back pressure chamber 67.

A tubular guide member 86 having an insertion hole 86*h*, which receives the valve body 70E, is press fitted in a part of the second housing 52 closer to the back pressure chamber 67. Moreover, an annular valve seat member 65A is provided at a position in the second housing 52 that closer to the introduction chamber 59A than the guide member 86. A valve hole 65H is formed at the center of the valve seat member 65A. A valve chamber 87 is formed between the guide member 86 and the valve seat member 65A in the second housing 52. A communicating chamber 66A is formed between the valve chamber 87 and the introduction chamber 59A in the second housing 52. The valve chamber 87 and the communicating chamber 66A communicate with each other via the valve hole 65H.

The valve body 70E is provided with a first valve portion 702E as a valve portion, which is accommodated in the valve chamber 87 and has an outer surface sealing portion 701E, which enters the valve hole 65H. Moreover, the valve body 70E is provided with a second valve portion 704E. The second valve portion 704E is located at a position closer to the guide member 86 than the first valve portion 702E and has an outer surface sealing portion 703E. The outer surface sealing portion 703E enters the insertion hole 86*h* of the guide member 86. Furthermore, the valve body 70E has a reduced diameter portion 705E and an insertion portion 706E. The reduced diameter portion 705E is continuous with a portion of the second valve portion 704E on the opposite side from the first valve portion 702E and has a diameter smaller than the second valve portion 704E. The insertion portion 706E is continuous with the reduced diameter portion 705E and projects through the insertion hole 86*h* into the back pressure chamber 67. A columnar projection portion 707E extends from the end face of the first valve portion 702E facing the valve seat member 65A through the valve hole 65H toward the introduction chamber 59A. A sealing portion 708E for sealing the boundary between the communicating chamber 66A and the introduction chamber 59A is fitted in a tip portion of the projection portion 707E.

The first valve portion 702E and the second valve portion 704E have the same outer diameter. The outer diameter of the sealing portion 708E is larger than the outer diameter of the first valve portion 702E and the second valve portion 704E. Moreover, the first valve portion 702E, the second valve portion 704E and the insertion portion 706E have the same outer diameter. A space 709E is formed between the reduced diameter portion 705E and the guide member 86. The valve body 70E has an in-shaft passage 88, which is located inside the guide member 86 and connects the back pressure chamber 67 and the space 709E with each other.

The pressure in the back pressure chamber 67, i.e., the pressure at the second pressure monitoring point P2 acts on the end face of the valve body 70E in the vicinity of the back pressure chamber 67. Accordingly, the pressure at the first pressure monitoring point P1 acts on a working surface 710E of the sealing portion 708E facing the introduction chamber 59A. Moreover, the pressure at the second pressure monitoring point P2 acts on the end face of the valve body 70E in the vicinity of the back pressure chamber 67. This applies the load based on the point-to-point differential pressure to the valve body 70E toward the solenoid portion 53.

The valve chamber 87 communicates with the pressure adjusting chamber 15*c* via a communicating hole 521B, which extends through the second housing 52, and a passage 81B. Accordingly, the passage 84, the communicating hole 524, the back pressure chamber 67, the in-shaft passage 88, the space 709E, the valve chamber 87, the communicating hole 521B, the passage 81B, the pressure adjusting chamber 15*c*, the first in-shaft passage 21*a*, and the second in-shaft passage 21*b* form a supply passage extending from the second pressure monitoring point P2 to the control pressure chamber 35.

The communicating chamber 66A communicates with the suction chamber 15*a* via a communicating hole 522B, which extends through the second housing 52, and a passage 82B. Accordingly, the second in-shaft passage 21*b*, the first in-shaft passage 21*a*, the pressure adjusting chamber 15*c*, the passage 81B, the communicating hole 521B, the valve chamber 87, the valve hole 65H, the communicating chamber 66A, the communicating hole 522B, and the passage 82B form a bleed passage extending from the control pressure chamber 35 to the suction chamber 15*a*.

When the air conditioner switch 50*s* is turned off, electricity supply to the solenoid portion 53 is stopped. In such a state, the load based on the point-to-point differential pressure acts toward the solenoid portion 53, and thus the valve body 70E moves toward the solenoid portion 53. This causes the second valve portion 704E to enter the insertion hole 86*h* and causes the outer surface sealing portion 703E to seal the boundary between the space 709E and the valve chamber 87. Accordingly, the second valve portion 704E is put into a closed state to close the supply passage. The first valve portion 702E exits the valve hole 65H, so that the valve chamber 87 and the communicating chamber 66A communicate with each other via the valve hole 65H. Accordingly, the first valve portion 702E is put into an open state to open the bleed passage. Refrigerant gas is discharged from the control pressure chamber 35 via the bleed passage to the suction chamber 15*a*, and thus the pressure in the control pressure chamber 35 approaches the pressure in the suction chamber 15*a*. This reduces the inclination angle of the swash plate 23 and thus reduces the stroke of the double-headed pistons 25. Accordingly, the displacement is decreased.

When the air conditioner switch 50*s* is turned on, electricity is supplied to the solenoid portion 53. Then, the solenoid portion 53 applies to the valve body 70E an urging force that counters the load applied to the valve body 70E based on the point-to-point differential pressure. This moves the valve body 70E toward the pressure sensing mechanism 60 and causes the second valve portion 704E to exit the insertion hole 86*h*, so that the space 709E and the valve chamber 87 communicate with each other. Accordingly, the second valve portion 704E is put into an open state to open the supply passage. The first valve portion 702E enters the valve hole 65H, and thus the outer surface sealing portion 701E seals the boundary between the valve chamber 87 and the communicating chamber 66A. Accordingly, the first valve portion 702E is put into a closed state to close the bleed passage. This supplies the pressure at the second pressure monitoring point P2 via the supply passage to the control pressure chamber 35, and thus the pressure in the control pressure chamber 35 approaches the pressure in the discharge chamber 15*b*. This increases the inclination angle of the swash plate 23 and thus increases the stroke of the double-headed pistons 25. Accordingly, the displacement is increased.

Operation of the seventh embodiment will now be described.

Between a working surface 711E of the sealing portion 708E facing the communicating chamber 66A and a working surface 712E of the first valve portion 702E facing the communicating chamber 66A, the pressure in the communicating chamber 66A, i.e., the pressure in the suction chamber 15*a* acts on the working surface 711E by the amount by which the outer diameter of the sealing portion 708E is larger. Accordingly, the load based on the DS differential pressure, which is the differential pressure between the pressure at the first pressure monitoring point P1 and the pressure in the suction chamber 15*a* acts on the valve body 70E in the same direction as the direction of the load applied to the valve body 70E based on the point-to-point differential pressure.

Therefore, in addition to advantages equivalent to the advantages (1), (2) of the first embodiment and the advantage (6) of the sixth embodiment, the seventh embodiment achieves the following advantages.

(7) Since the guide member 86 is a body separated from the second housing 52, it is easy to align the axis of the valve body 70E with the axis of the guide member 86. That is, the accuracy of centering of the valve body 70E and the guide member 86 is heightened, and thus seal efficiency of the outer surface sealing portion 703E is improved.

(8) The valve body 70E has the in-shaft passage 88, which is located inside the guide member 86. This makes it easy to form a press fit part of the guide member 86 fitted with the second housing 52 in comparison with a case where, for example, an opening is formed on the outer surface of the guide member 86 and a communicating passage that communicates with the space 709E is also formed.

Eighth Embodiment

A variable displacement swash plate type compressor according to an eighth embodiment will now be described with reference to FIG. 12. In the following description of the eighth embodiment, only differences from the above described seventh embodiment will be discussed.

Figure 12:
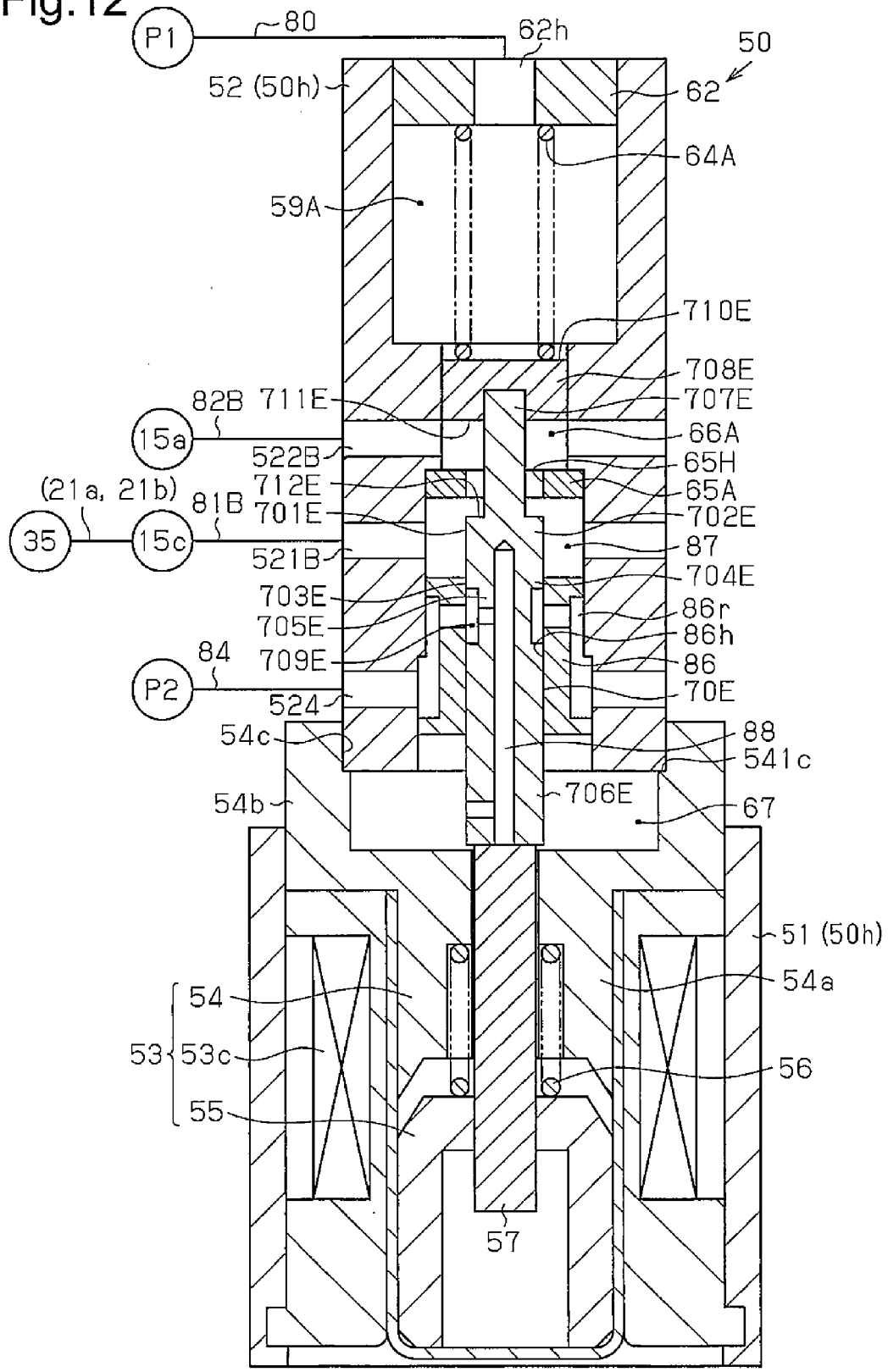
FIG. 12 is a cross-sectional view showing a control valve according to an eighth embodiment.

As illustrated in FIG. 12, the guide member 86 has a communicating passage 86*r*, which has an opening at the outer surface and communicates with the space 709E. The communicating passage 86*r* communicates with the communicating hole 524. Accordingly, the passage 84, the communicating hole 524, the communicating passage 86*r*, the space 709E, the valve chamber 87, the communicating hole 521B, the passage 81B, the pressure adjusting chamber 15*c*, the first in-shaft passage 21*a*, and the second in-shaft passage 21*b* form a supply passage extending from the second pressure monitoring point P2 to the control pressure chamber 35. Refrigerant gas flowing in the supply passage is supplied via the in-shaft passage 88 to the back pressure chamber 67.

Ninth Embodiment

A variable displacement swash plate type compressor according to a ninth embodiment will now be described with reference to FIG. 13. In the following description of the ninth embodiment, only differences from the above described sixth embodiment will be discussed.

Figure 13:
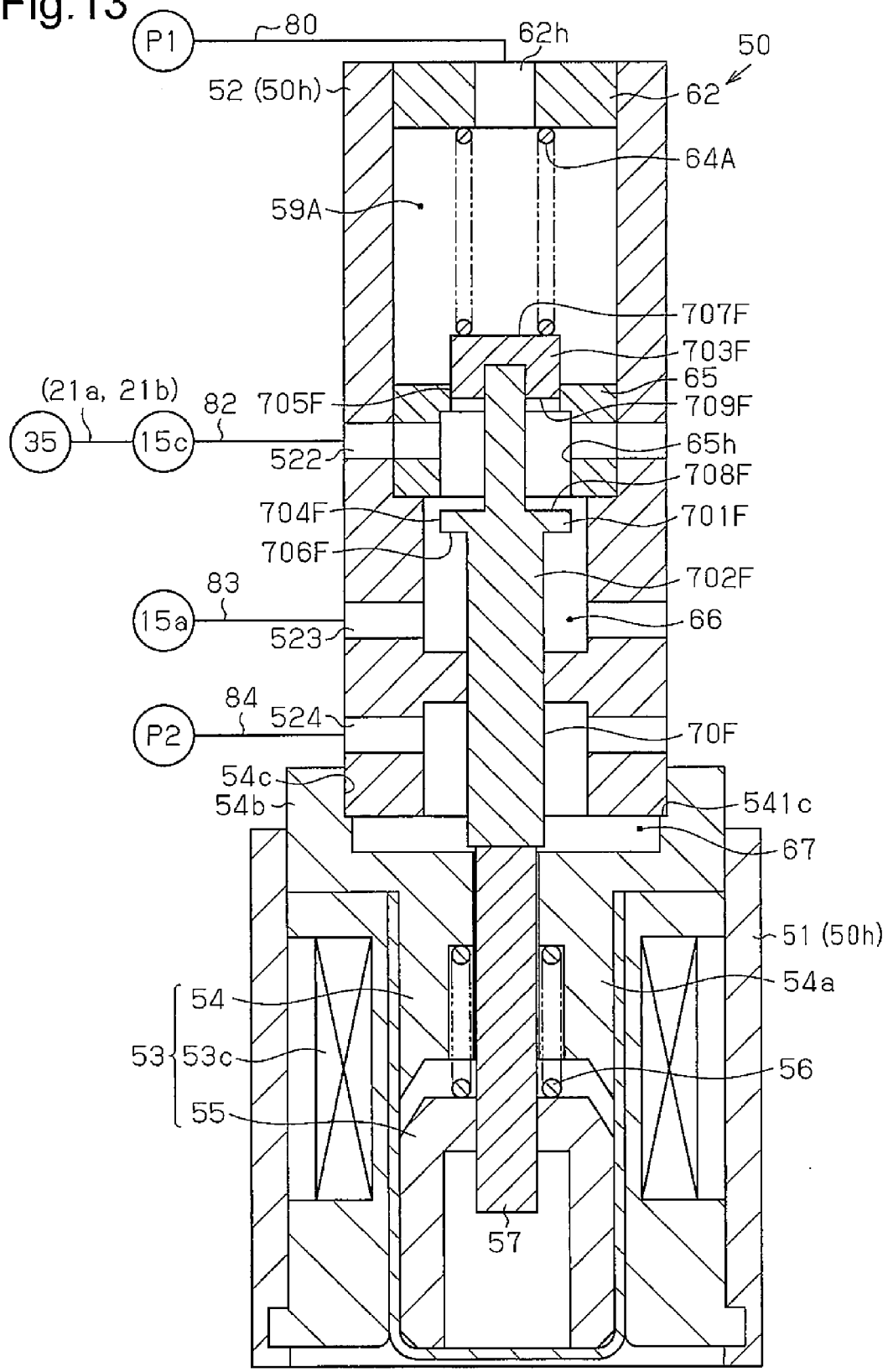
FIG. 13 is a cross-sectional view showing a control valve according to a ninth embodiment.

As illustrated in FIG. 13, a valve body 70F is composed of a first valve body member 702F and an annular second valve portion 703F as a valve portion. The first valve body member 702F extends from the back pressure chamber 67 to the introduction chamber 59A and has an annular first valve portion 701F as a valve portion. The second valve portion 703F is coupled to an end portion of the first valve body member 702F facing the introduction chamber 59A. The first valve body member 702F seals the boundary between the back pressure chamber 67 and the communicating chamber 66. The outer diameter of the first valve portion 701F is larger than the outer diameter of the second valve portion 703F. The diameter of the valve hole 65*h* in the vicinity of the first valve portion 701F is larger than the diameter of the valve hole 65*h* in the vicinity of the second valve portion 703F. The first valve portion 701F has an outer surface sealing portion 704F, which enters the valve hole 65*h* to seal the boundary between the valve hole 65*h* and the communicating chamber 66. The second valve portion 703F has an outer surface sealing portion 705F, which enters the valve hole 65*h* to seal the boundary between the valve hole 65*h* and the introduction chamber 59A.

The pressure in the communicating chamber 66, i.e., the pressure in the suction chamber 15*a* acts on a working surface 706F of the first valve portion 701F in the valve body 70F on the opposite side from the valve seat member 65. Moreover, the pressure in the introduction chamber 59A, i.e., the pressure at the first pressure monitoring point P1 acts on a working surface 707F of the second valve portion 703F facing the introduction chamber 59A.

Operation of the ninth embodiment will now be described.

Between a working surface 708F of the first valve portion 701F facing the valve hole 65*h* and a working surface 709F of the second valve portion 703F facing the valve hole 65*h*, the pressure in the valve hole 65*h*, i.e., the pressure in the control pressure chamber 35 acts on the working surface 708F by the amount by which the outer diameter of the first valve portion 701F is larger. Accordingly, the pressure in the suction chamber 15*a* acts on the working surface 706F of the first valve portion 701F on the opposite side of the valve seat member 65. Moreover, the pressure in the control pressure chamber 35 acts on the working surface 708F of the first valve portion 701F on the side corresponding to the valve hole 65*h*. This causes the load based on the CS differential pressure, which is a differential pressure between the pressure in the control pressure chamber 35 and the pressure in the suction chamber 15*a* to act on the valve body 70F in the same direction as the direction of the load applied to the valve body 70F based on the point-to-point differential pressure.

Moreover, the pressure in the suction chamber 15*a* acts on the working surface 706F of the first valve portion 701F on the opposite side from the valve seat member 65. Moreover, the pressure at the first pressure monitoring point P1 acts on the working surface 707F of the second valve portion 703F on the side corresponding to the introduction chamber 59A. With such a structure, the load based on the DS differential pressure, which is a differential pressure between the pressure at the first pressure monitoring point P1 and the pressure in the suction chamber 15*a* acts on the valve body 70F in the same direction as the direction of the load applied to the valve body 70C based on the point-to-point differential pressure.

Therefore, in addition to advantages equivalent to the advantages (1), (2) of the first embodiment and the advantage (6) of the fifth embodiment, the ninth embodiment achieves the following advantage.

(9) In addition to the load based on the DS differential pressure, the load based on the CS differential pressure acts on the valve body 70F in the same direction as the direction of the load applied to the valve body 70F based on the point-to-point differential pressure. With such a structure, fluctuation in the DS differential pressure is small in a region where the flow rate of refrigerant gas is small, and fluctuation in the CS differential pressure can also be taken into consideration. This makes it easy to make fluctuation in the flow rate of refrigerant gas with respect to fluctuation in the point-to-point differential pressure smaller in a region where the flow rate of refrigerant gas is small.

Tenth Embodiment

A variable displacement swash plate type compressor according to a tenth embodiment will now be described with reference to FIGS. 14 and 15.

Figure 14:
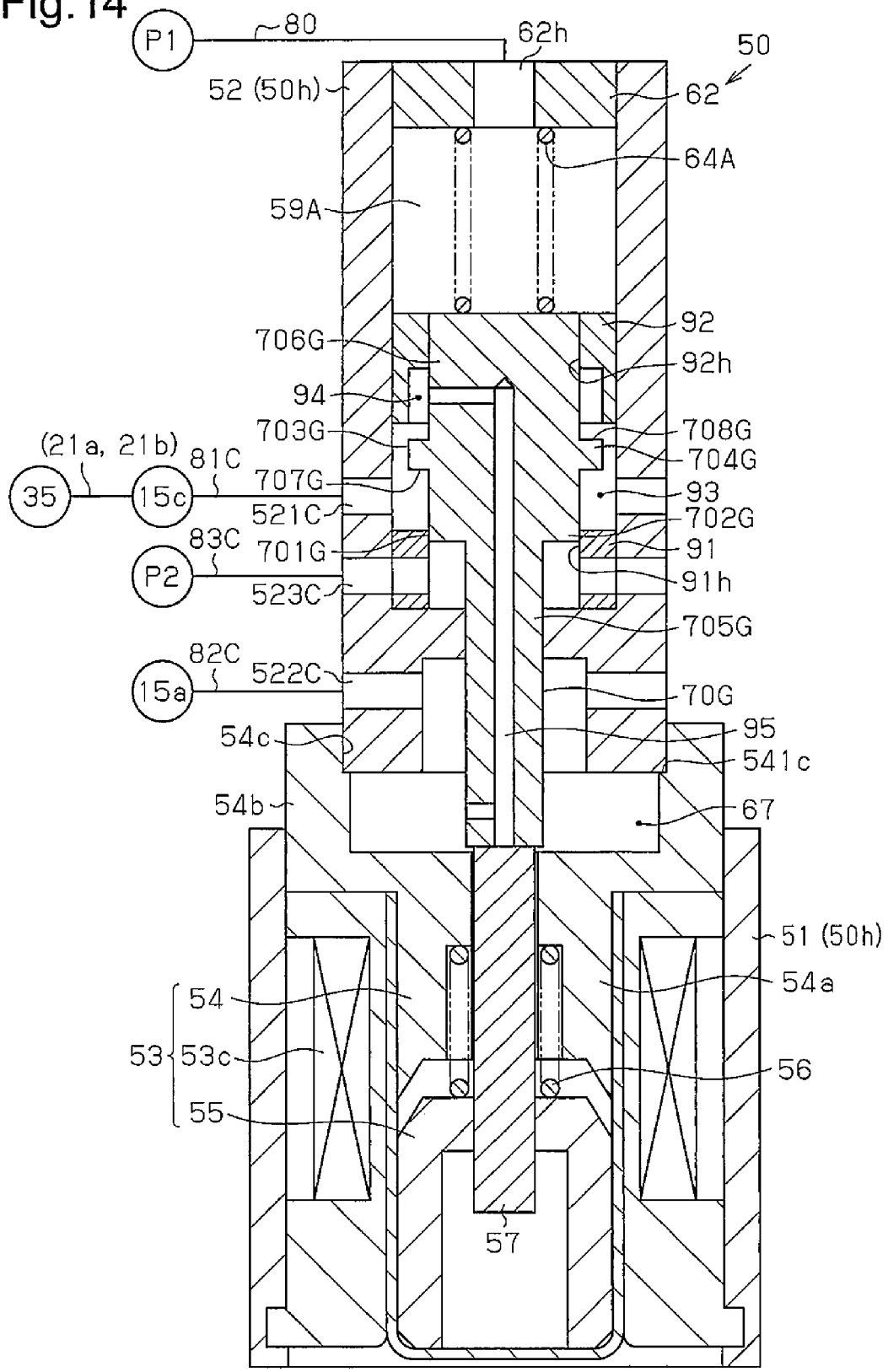
FIG. 14 is a cross-sectional view showing a control valve according to a tenth embodiment.

As illustrated in FIG. 14, the second housing 52 accommodates an annular first valve seat member 91. A first valve hole 91*h* is formed at the center of the first valve seat member 91. Moreover, The second housing 52 accommodates an annular second valve seat member 92 at a position closer to the introduction chamber 59A than the first valve seat member 91. A second valve hole 92*h* is formed at the center of the second valve seat member 92. A valve chamber 93 is formed between the first valve seat member 91 and the second valve seat member 92 in the second housing 52. The second valve hole 92*h* has a stepped shape, and the diameter of the second valve hole 92*h* in the vicinity of the valve chamber 93 is larger than the diameter of the second valve hole 92*h* in the vicinity of the introduction chamber 59A. The diameter of the first valve hole 91*h* is equal to the diameter of the second valve hole 92*h* in the vicinity of the valve chamber 93.

The valve housing 50*h* accommodates a valve body 70G extending from the back pressure chamber 67 to the introduction chamber 59A. The valve body 70G is provided with a first valve portion 702G as a valve portion. The first valve portion 702G has an outer surface sealing portion 701G, which enters the first valve hole 91*h* to seal the boundary between the first valve hole 91*h* and the valve chamber 93. Moreover, the valve body 70G is provided with an annular second valve portion 704G as a valve portion. The second valve portion 704G has an outer surface sealing portion 703G, which is accommodated in the valve chamber 93 and enters the second valve hole 92*h* to seal the boundary between the second valve hole 92*h* and the valve chamber 93. The outer diameter of the second valve portion 704G is larger than the outer diameter of the first valve portion 702G.

Furthermore, the valve body 70G has a columnar first projection portion 705G, which projects from the first valve portion 702G. The outer diameter of the first projection portion 705G is smaller than the outer diameter of the first valve portion 702G. The first projection portion 705G extends through the inside of the first valve hole 91*h* and projects through a bottom portion of the second housing 52 into the back pressure chamber 67. The first projection portion 705G seals the boundary between the back pressure chamber 67 and the inside of the first valve hole 91*h*. Moreover, the valve body 70G has a columnar second projection portion 706G, which projects from the second valve portion 704G. The outer diameter of the second projection portion 706G is equal to the outer diameter of the first valve portion 702G. A space 94 is formed between the second projection portion 706G and a portion of the second valve hole 92*h* on the side corresponding to the valve chamber 93. Between the portion of the second valve hole 92*h* on the side corresponding to the introduction chamber 59A, the second projection portion 706G seals the boundary between the space 94 and the introduction chamber 59A.

The valve body 70G has an in-shaft passage 95, which connects the back pressure chamber 67 and the space 94 with each other. Moreover, the valve chamber 93 communicates with the pressure adjusting chamber 15*c* via a communicating hole 521C, which extends through the second housing 52, and a passage 81C. Furthermore, the back pressure chamber 67 communicates with the suction chamber 15*a* via a communicating hole 522C, which extends through the second housing 52, and a passage 82C. Accordingly, the second in-shaft passage 21*b*, the first in-shaft passage 21*a*, the pressure adjusting chamber 15*c*, the passage 81C, the communicating hole 521C, the valve chamber 93, the space 94, the in-shaft passage 95, the back pressure chamber 67, the communicating hole 522C and the passage 82C form a bleed passage extending from the control pressure chamber 35 to the suction chamber 15*a*.

The inside of the first valve hole 91*h* is connected to the second pressure monitoring point P2 via a communicating hole 523C, which extends through the first valve hole 91*h* and the second housing 52, and a passage 83C. Accordingly, the passage 83C, the communicating hole 523C, the first valve hole 91*h*, the valve chamber 93, the communicating hole 521C, the passage 81C, the pressure adjusting chamber 15*c*, the first in-shaft passage 21*a* and the second in-shaft passage 21*b* form a supply passage extending from the second pressure monitoring point P2 to the control pressure chamber 35.

The pressure in the inside of the first valve hole 91*h*, i.e., the pressure at the second pressure monitoring point P2 acts on the end face of the first valve portion 702G. The pressure in the introduction chamber 59A, i.e., the pressure at the first pressure monitoring point P1 acts on the end face of the second projection portion 706G. This applies the load based on the point-to-point differential pressure to the valve body 70G toward the solenoid portion 53.

When the air conditioner switch 50*s* is turned off, electricity supply to the solenoid portion 53 is stopped. In such a state, the load based on the point-to-point differential pressure acts toward the solenoid portion 53, and thus the valve body 70G moves toward the solenoid portion 53. This causes the first valve portion 702G to enter the first valve hole 91*h* and causes the outer surface sealing portion 701G to seal the boundary between the first valve hole 91*h* and the valve chamber 93. Accordingly, the first valve portion 702G is put into a closed state to close the supply passage. The second valve portion 704G exits the second valve hole 92*h*, so that the valve chamber 93 and the space 94 communicate with each other. Accordingly, the second valve portion 704G is put into an open state to open the bleed passage. Refrigerant gas is discharged from the control pressure chamber 35 via the bleed passage to the suction chamber 15*a*, and thus the pressure in the control pressure chamber 35 approaches the pressure in the suction chamber 15*a*. This reduces the inclination angle of the swash plate 23 and thus reduces the stroke of the double-headed pistons 25. Accordingly, the displacement is decreased.

When the air conditioner switch 50*s* is turned on, electricity is supplied to the solenoid portion 53. Then, the solenoid portion 53 applies to the valve body 70G an urging force that counters the load applied to the valve body 70G based on the point-to-point differential pressure, and the valve body 70G moves toward the introduction chamber 59A. The first valve portion 702G exits the first valve hole 91*h*, so that the first valve hole 91*h* and the valve chamber 93 communicate with each other. Accordingly, the first valve portion 702G is put into an open state to open the supply passage. The second valve portion 704G enters the second valve hole 92*h*, and the outer surface sealing portion 703G seals the boundary between the second valve hole 92*h* and the valve chamber 93. Accordingly, the second valve portion 704G is put into a closed state to close the bleed passage. This supplies the pressure at the second pressure monitoring point P2 via the supply passage to the control pressure chamber 35, and thus the pressure in the control pressure chamber 35 approaches the pressure in the discharge chamber 15*b*. This increases the inclination angle of the swash plate 23 and thus increases the stroke of the double-headed pistons 25. Accordingly, the displacement is increased.

Operation of the tenth embodiment will now be described.

The pressure in the back pressure chamber 67, i.e., the pressure in the suction chamber 15*a* acts on the end face of the valve body 70G in the vicinity of the back pressure chamber 67. Accordingly, the pressure in the suction chamber 15*a* acts on the end face of the valve body 70G in the vicinity of the back pressure chamber 67. Moreover, the pressure at the first pressure monitoring point P1 acts on the end face of the second projection portion 706G. This causes the load based on the DS differential pressure, which is a differential pressure between the pressure at the first pressure monitoring point P1 and the pressure in the suction chamber 15*a*, to act on the valve body 70G in the same direction as the direction of the load applied to the valve body 70G based on the point-to-point differential chamber.

Furthermore, the pressure in the valve chamber 93, i.e., the pressure in the control pressure chamber 35 acts on a working surface 707G of the second valve portion 704G facing the first valve seat member 91. Moreover, the pressure in the space 94, i.e., the pressure in the suction chamber 15*a* acts on a working surface 708G of the second valve portion 704G facing the second valve seat member 92. This causes the load based on a CS differential pressure which is a differential pressure between the pressure in the control pressure chamber 35 and the pressure in the suction chamber 15*a* to further act on the valve body 70G in an direction opposite to the direction of the load applied to the valve body 70G based on the point-to-point differential pressure. The direction opposite to the direction of the load refers to the same direction as the direction of urging force applied to the valve body 70G by the solenoid portion 53.

Figure 15:
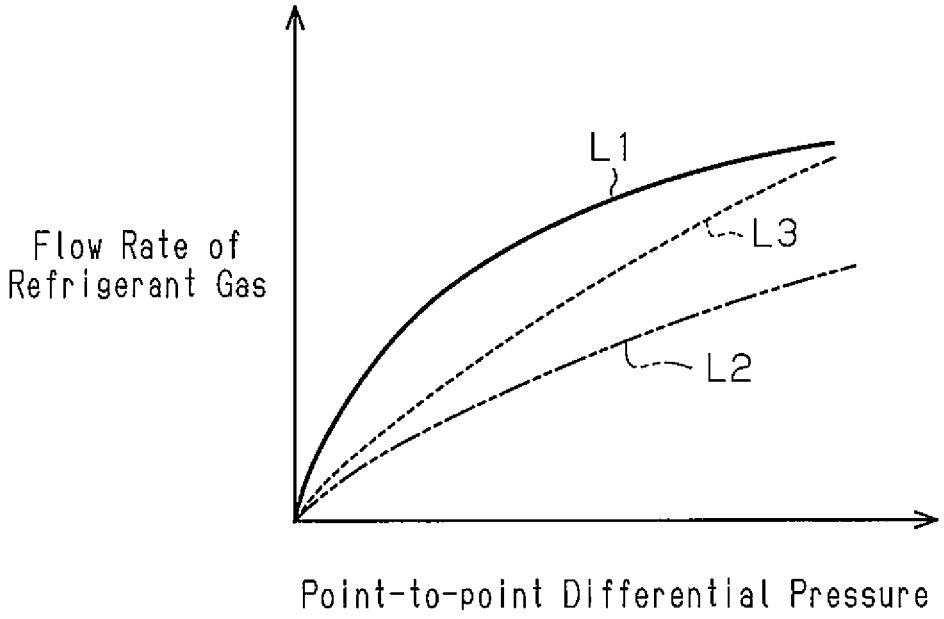
FIG. 15 is a graph illustrating the relationship between a point-to-point differential pressure and the flow rate of refrigerant gas.

The broken line in the graph of FIG. 15 is a characteristic line L3 illustrating the relationship between the point-to-point differential pressure and the flow rate of refrigerant gas. The characteristic line L3 is obtained in a case where the load based on the CS differential pressure further acts on the valve body 70G in the direction opposite to the direction of the load applied to the valve body 70G based on the point-to-point differential pressure.

When the load based on the DS differential pressure is caused to act on the valve body 70G in the same direction as the direction of the load applied to the valve body 70G based on the point-to-point differential pressure, fluctuation in the flow rate of refrigerant gas with respect to fluctuation in the point-to-point differential pressure is unlikely to occur in the process of controlling the opening degree of the first valve portion 702G and the second valve portion 704G with the solenoid portion 53 even in a region where the flow rate of refrigerant gas is large. The load based on the CS differential pressure is therefore caused act on the valve body 70G in the direction opposite to the direction of the load applied to the valve body 70G based on the point-to-point differential pressure. The greater the displacement, the higher the CS differential pressure becomes. Thus, in a region where the flow rate of refrigerant gas is large, the load that acts on the valve body 70G in the direction opposite to the direction of the load applied to the valve body 70G based on the point-to-point differential pressure is large in comparison with a region where the flow rate of refrigerant gas is small. As a result, fluctuation in the flow rate of refrigerant gas with respect to fluctuation in the point-to-point differential pressure becomes larger in the characteristic line L3 as the flow rate of refrigerant gas becomes larger, in comparison with the characteristic line L2.

Therefore, in addition to advantages equivalent to the advantages (1), (2) of the first embodiment and the advantage (6) of the sixth embodiment, the tenth embodiment achieves the following advantage.

(10) The load based on the CS differential pressure, which is a differential pressure between the pressure in the control pressure chamber 35 and the pressure in the suction chamber 15*a*, is further caused to act on the valve body 70G in the direction opposite to the direction of the load applied to the valve body 70G based on the point-to-point differential pressure. The CS differential pressure becomes larger as the displacement becomes larger. This makes the load based on the CS differential pressure, which acts on the valve body 70G in the direction opposite to the direction of the load applied to the valve body 70G based on the point-to-point differential pressure, larger in a region where the flow rate of refrigerant gas is large in comparison with a region where the flow rate of refrigerant gas is small. As a result, fluctuation in the flow rate of refrigerant gas with respect to fluctuation in the point-to-point differential pressure becomes larger as the flow rate of refrigerant gas becomes larger. This reduces makes the urging force applied to the valve body 70G by the solenoid portion 53 even in a zone where the flow rate of refrigerant gas is large. As a result, it is possible to reduce the size of the solenoid portion 53.

Eleventh Embodiment

A variable displacement swash plate type compressor according to an eleventh embodiment will now be described with reference to FIGS. 16 to 19.

Figure 16:
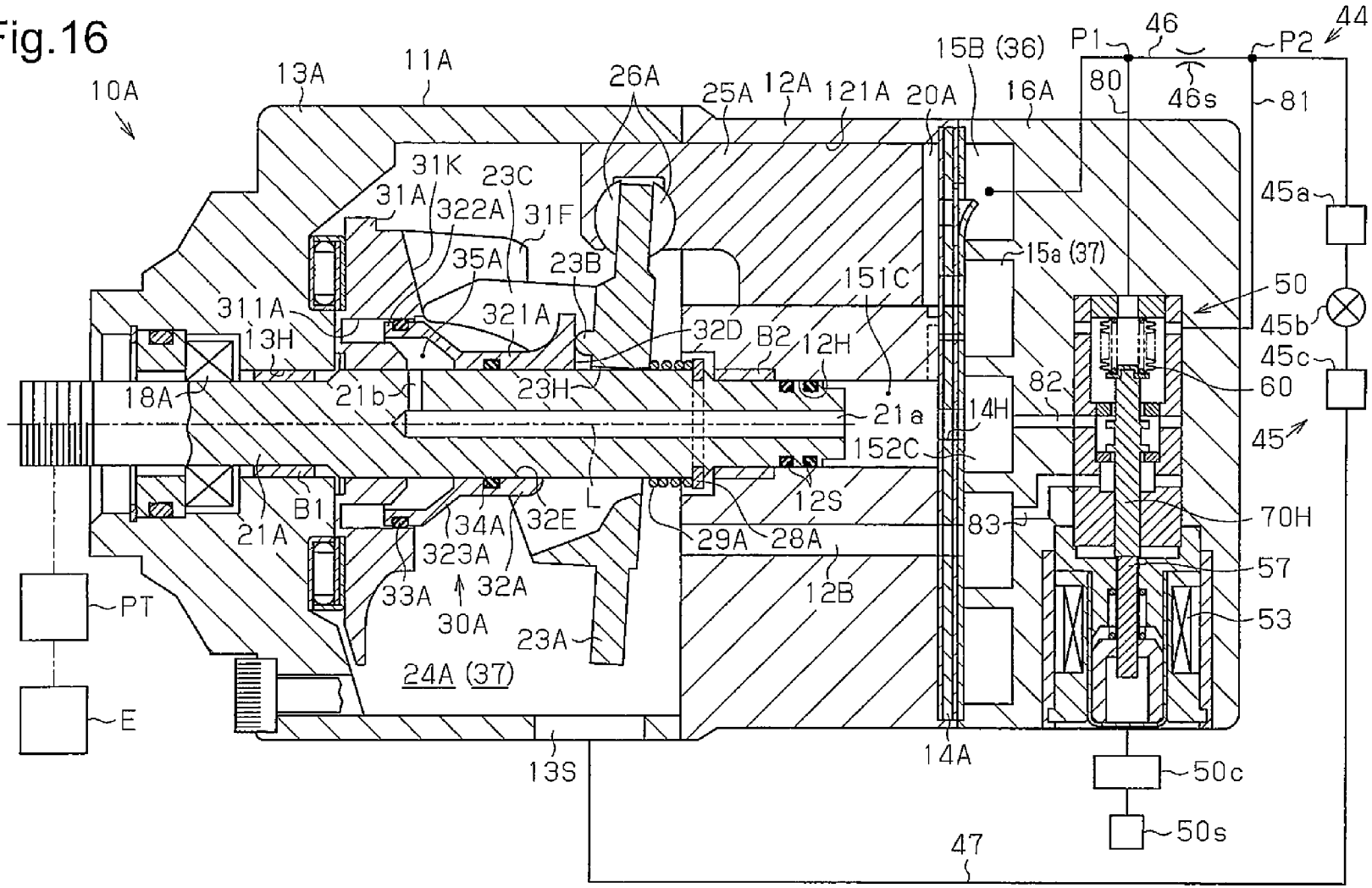
FIG. 16 is a cross-sectional side view illustrating a variable displacement swash plate type compressor according to an eleventh embodiment.

As shown in FIG. 16, the variable displacement swash plate type compressor 10A includes a housing 11A, which is formed by a cylinder block 12A, a front housing member 13A, and a rear housing member 16A. The front housing member 13A is secured to one end (left end as viewed in FIG. 16) of the cylinder block 12A. The rear housing member 16A is secured to the other end (right end as viewed in FIG. 16) of the cylinder block 12A with a valve plate 14A in between. In the housing 11A, the cylinder block 12A and the front housing member 13A define in between a swash plate chamber 24A.

A rotary shaft 21A is rotationally supported in the housing 11A. One end of the rotary shaft 21A along the rotational axis L (the axis of the rotary shaft 21A) on the front end located on the front end (first side) of the housing 11A is received in a shaft hole 13H provided through the front housing member 13A. The front end of the rotary shaft 21A projects from the front housing member 13A. Moreover, the other end of the rotary shaft 21A along a direction in which the rotational axis L extends on the rear side located on the rear side (second side) of the housing 11A extends through the shaft hole 12H provided through the cylinder block 12A.

A first sliding bearing B1 is arranged in the shaft hole 13H and the front end of the rotary shaft 21A is rotationally supported in the front housing member 13A via the first sliding bearing B1. A second sliding bearing B2 is arranged in the shaft hole 12H and the rear end of the rotary shaft 21A is rotationally supported in the cylinder block 12A via the second sliding bearing B2. A sealing device 18A of lip seal type is located between the front housing member 13A and the rotary shaft 21A. The front end of the rotary shaft 21A is connected to and driven by an external drive source, which is a vehicle engine E in this embodiment, through a power transmission mechanism PT. In this embodiment, the power transmission mechanism PT is a normally transmitting type clutchless mechanism. The power transmission mechanism PT is constituted by combination of a belt and a pulley, for example.

A seal ring 12S is provided between the cylinder block 12A and the rotary shaft 21A. The seal ring 12S seals the boundary between a first pressure adjusting chamber 151C, which is a space located closer to the valve plate 14A than the seal ring 12S in the shaft hole 12H, and the swash plate chamber 24A.

The swash plate chamber 24A accommodates a swash plate 23A, which is rotated by drive force from the rotary shaft 21A and tiltable in the axial direction with respect to the rotary shaft 21A. The swash plate 23A has an insertion hole 23H, which receives the rotary shaft 21A. The rotary shaft 21A is received in the insertion hole 23H, and thus the swash plate 23A is attached to the rotary shaft 21A.

The cylinder block 12A has cylinder bores 121A, which are formed to extend in the axial direction of the cylinder block 12A and arranged around the rotary shaft 21A. Only one cylinder bore 121A is illustrated in FIG. 16. A single-headed piston 25A is accommodated in each cylinder bore 121A to reciprocate between a top dead center position and a bottom dead center position. The openings of each cylinder bore 121A are closed by the valve plate 14A and the corresponding single-headed piston 25A. A compression chamber 20A, which changes in volume in accordance with reciprocation of a corresponding single-headed piston 25A, is defined in each cylinder bore 121A. Each single-headed piston 25A is engaged with the periphery of the swash plate 23A with two shoes 26A. The shoes 26A convert rotation of the swash plate 23A, which rotates with the rotary shaft 21A, to linear reciprocation of the single-headed pistons 25A.

Accordingly, each pair of the shoes 26A serves as a conversion mechanism, which reciprocates the corresponding single-headed piston 25A in the cylinder bore 121A in accordance with rotation of the swash plate 23A.

A suction chamber 15A and a discharge chamber 15B which surrounds the suction chamber 15A are defined between the valve plate 14A and the rear housing member 16A.

Moreover, a second pressure adjusting chamber 152C is defined between the valve plate 14A and the rear housing member 16A. The second pressure adjusting chamber 152C is located at the center of the rear housing member 16A, and the suction chamber 15A is located outside the second pressure adjusting chamber 152C in the radial direction. The valve plate 14A has a communicating hole 14H, which connects the first pressure adjusting chamber 151C and the second pressure adjusting chamber 152C with each other.

The swash plate chamber 24A and the suction chamber 15A communicate with each other via a suction passage 12B, which extends through the cylinder block 12A and the valve plate 14A. A suction inlet 13S is formed in a peripheral wall of the front housing member 13A.

The variable displacement swash plate type compressor 10A constitutes part of a refrigerant circuit (cooling circuit) 44 for a vehicle air conditioner. The refrigerant circuit 44 is provided with the variable displacement swash plate type compressor 10A and the external refrigerant circuit 45. The discharge chamber 15B is connected to an inlet of the condenser 45*a* via the discharge passage 46. An outlet of the evaporator 45*c* is connected to the suction inlet 13S via the suction passage 47. The restrictor 46*s* is provided at the middle of the discharge passage 46. The restrictor 46*s* lowers discharge pulsation of refrigerant gas. Refrigerant gas discharged to the discharge chamber 15B flows through the discharge passage 46, the external refrigerant circuit 45 and the suction passage 47 and is drawn from the suction inlet 13S to the swash plate chamber 24A. Refrigerant gas drawn to the swash plate chamber 24A is drawn via the suction passage 12B to the suction chamber 15A. Accordingly, the suction chamber 15A and the swash plate chamber 24A are in a suction pressure zone 37. The suction chamber 15A and the swash plate chamber 24A have substantially equal pressures.

The swash plate chamber 24A accommodates an actuator 30A, which changes the inclination angle of the swash plate 23A with respect to a direction perpendicular to the rotational axis L of the rotary shaft 21A at the swash plate 23A. The actuator 30A has a lug plate 31A as a partition body, which is provided at a portion of the rotary shaft 21A on the further forward of the swash plate 23A. The lug plate 31A has a circular plate form and rotates integrally with the rotary shaft 21A. Moreover, the actuator 30A has a cylindrical movable body 32A having a closed end. The movable body 32A moves in the axial direction of the rotary shaft 21A with respect to the lug plate 31A.

The movable body 32A is composed of a first cylindrical portion 321A, a second cylindrical portion 322A, and an annular coupling portion 323A. The first cylindrical portion 321A has an insertion hole 32E, which receives the rotary shaft 21A. The second cylindrical portion 322A extends in the axial direction of the rotary shaft 21A and has a diameter larger than the diameter of the first cylindrical portion 321A. The coupling portion 323A couples the first cylindrical portion 321A and the second cylindrical portion 322A with each other. A tip portion of the second cylindrical portion 322A slides in an annular guide groove 311A formed in the lug plate 31A with respect to a surface of the guide groove 311A facing the peripheral surface of the second cylindrical portion 322A. This allows the movable body 32A to rotate integrally with the rotary shaft 21A via the lug plate 31A. A sealing member 33A seals the boundary between the peripheral surface of the second cylindrical portion 322A and a surface of the guide groove 311A facing the peripheral surface of the second cylindrical portion 322A. Moreover, a sealing member 34A seals the boundary between the insertion hole 32E and the rotary shaft 21A. The actuator 30A has a control pressure chamber 35A, which is defined by the lug plate 31A and the movable body 32A.

A protrusion 23B is formed to project from a portion of the swash plate 23A facing the movable body 32A. A surface of the first cylindrical portion 321A facing the protrusion 23B forms a pressing surface 32D, which contacts the protrusion 23B and presses the swash plate 23A.

The lug plate 31A has a pair of arms 31F, which projects toward the swash plate 23A. A projection 23C is formed on the upper end side of the swash plate 23A to project toward the lug plate 31A. The projection 23C is inserted between two arms 31F. The projection 23C moves between two arms 31F while being sandwiched between two arms 31F. A cam surface 31K is formed at a bottom portion between two arms 31F. A tip of the projection 23C is in sliding contact with the cam surface 31K. The swash plate 23A is tiltable in the axial direction of the rotary shaft 21A in cooperation with the cam surface 31K and the projection 23C sandwiched by two arms 31F. Drive force of the rotary shaft 21A is transmitted via a pair of arms 31F to the projection 23C, and thus the swash plate 23A rotates. In the process of tilting of the swash plate 23A in the axial direction of the rotary shaft 21A, the projection 23C slides on the cam surface 31K. Accordingly, the projection 23C and the cam surface 31K form a link mechanism that allows change in the inclination angle of the swash plate 23A.

Moreover, a regulation ring 28A is fastened to a position of the rotary shaft 21A closer to the cylinder block 12A than the swash plate 23A. A spring 29A is mounted around the rotary shaft 21A between the regulation ring 28A and the swash plate 23A. The spring 29A urges the swash plate 23A so that the swash plate 23A tilts toward the lug plate 31A.

A first in-shaft passage 21*a* is formed in the rotary shaft 21A. The first in-shaft passage 21*a* extends along the axis L of the rotary shaft 21A. The rear end of the first in-shaft passage 21*a* is opened to the interior of the first pressure adjusting chamber 151C. A second in-shaft passage 21*b* is formed in the rotary shaft 21A. The second in-shaft passage 21*b* extends in the radial direction of the rotary shaft 21A. One end of the second in-shaft passage 21*b* communicates with the first in-shaft passage 21*a*. The other end of the second in-shaft passage 21*b* is opened to the interior of the control pressure chamber 35A. Accordingly, the control pressure chamber 35A and the first pressure adjusting chamber 151C are connected to each other by the first in-shaft passage 21*a* and the second in-shaft passage 21*b*.

Figure 17:
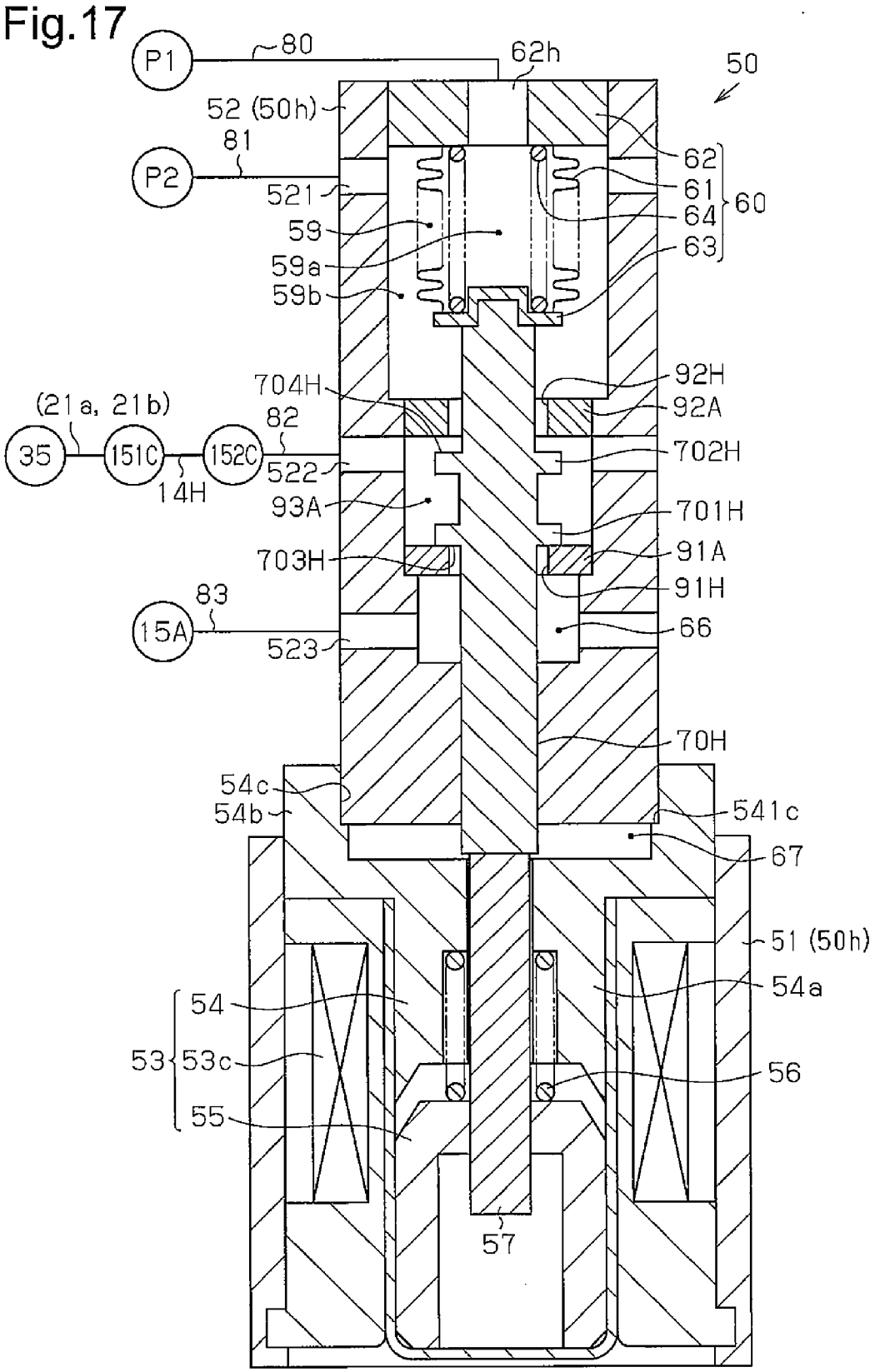
FIG. 17 is a cross-sectional view of a control valve when the swash plate is at the minimum inclination angle.

As illustrated in FIG. 17, an annular first valve seat member 91A is accommodated closer to the accommodation chamber 59 than the communicating chamber 66 in the second housing 52. A first valve hole 91H is formed at the center of the first valve seat member 91A. Moreover, an annular second valve seat member 92A is accommodated closer to the accommodation chamber 59 than the first valve seat member 91A in the second housing 52. A second valve hole 92H is formed at the center of the second valve seat member 92A. The first valve hole 91H and the second valve hole 92H have the same diameter. A valve chamber 93A is formed between the first valve seat member 91A and the second valve seat member 92A in the second housing 52.

The communicating chamber 66 and the valve chamber 93A communicate with each other via the first valve hole 91H. Accordingly, the second in-shaft passage 21*b*, the first in-shaft passage 21*a*, the first pressure adjusting chamber 151C, the communicating hole 14H, the second pressure adjusting chamber 152C, the passage 82, the communicating hole 522, the valve chamber 93A, the first valve hole 91H, the communicating chamber 66, the communicating hole 523 and the passage 83 form a bleed passage extending from the control pressure chamber 35 to the suction chamber 15*a*.

The valve chamber 93A and the accommodation chamber 59 communicate with each other via the second valve hole 92H. Accordingly, the passage 81, the communicating hole 521, the accommodation chamber 59, the second valve hole 92H, the valve chamber 93A, the communicating hole 522, the passage 82, the second pressure adjusting chamber 152C, the communicating hole 14H, the first pressure adjusting chamber 151C, the first in-shaft passage 21*a*, and the second in-shaft passage 21*b* form a supply passage extending from the second pressure monitoring point P2 to the control pressure chamber 35.

The valve housing 50*h* accommodates a valve body 70H extending from the back pressure chamber 67 to the accommodation chamber 59. The valve body 70H has a first valve portion 701H as an annular valve portion. The first valve portion 701H contacts the circumference of the first valve hole 91H on the end face of the first valve seat member 91A facing the valve chamber 93A. Moreover, the valve body 70H has a second valve portion 702H as an annular valve portion. The second valve portion 702H contacts the circumference of the second valve hole 92H on the end face of the second valve seat member 92A facing the valve chamber 93A. The first valve portion 701H and the second valve portion 702H have the same outer diameter. An end portion of the valve body 70H located in the accommodation chamber 59 is connected to and driven by the coupling body 63.

Regarding the variable displacement swash plate type compressor 10A having the above structure, electricity supply to the solenoid portion 53 is stopped when the air conditioner switch 50*s* is turned off. In such a state, the force of the spring 56 moves the movable iron core 55 away from the fixed iron core 54. In addition, the load based on the point-to-point differential pressure acts toward the solenoid portion 53, and thus the valve body 70H moves toward the solenoid portion 53. This causes the first valve portion 701H to contact the end face of the first valve seat member 91A facing the valve chamber 93A and moves the second valve portion 702H away from the end face of the second valve seat member 92A facing the valve chamber 93A.

Then, refrigerant gas is supplied to the control pressure chamber 35 from the second pressure monitoring point P2 via the passage 81, the communicating hole 521, the accommodation chamber 59, the second valve hole 92H, the valve chamber 93A, the communicating hole 522, the passage 82, the second pressure adjusting chamber 152C, the communicating hole 14H, the first pressure adjusting chamber 151C, the first in-shaft passage 21*a*, and the second in-shaft passage 21*b*, and the pressure in the control pressure chamber 35 approaches the pressure in the discharge chamber 15B.

As illustrated in FIG. 16, as the pressure in the control pressure chamber 35A approaches the pressure in the discharge chamber 15B and a pressure difference between the control pressure chamber 35A and the swash plate chamber 24A becomes larger, the movable body 32A moves such that the first cylindrical portion 321A of the movable body 32A moves away from the lug plate 31A. Then, the pressing surface 32D of the first cylindrical portion 321A in the movable body 32A presses the protrusion 23B, and thus the swash plate 23A is pressed in the direction away from the lug plate 31A against the urging force of the spring 29A. As the projection 23C slides on the cam surface 31K in the direction toward the rotary shaft 21A, the inclination angle of the swash plate 23A becomes smaller, and thus the stroke of the single-headed pistons 25A becomes smaller. Accordingly, the displacement decreases.

Figure 18:
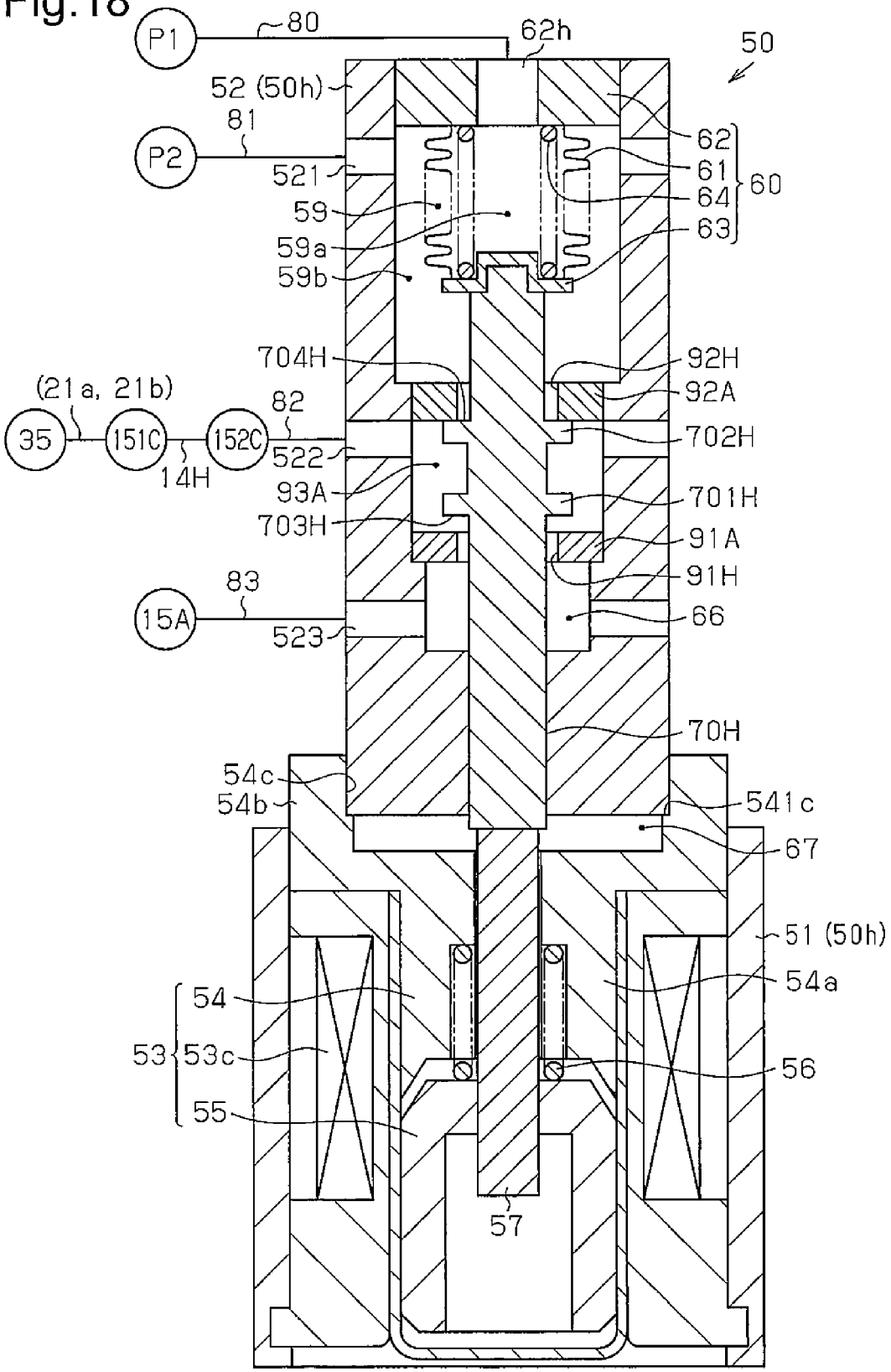
FIG. 18 is a cross-sectional view of the control valve when the swash plate is at the maximum inclination angle.

As illustrated in FIG. 18, regarding the variable displacement swash plate type compressor 10A having the above structure, electricity is supplied to the solenoid portion 53 when the air conditioner switch 50*s* is turned on. Then, electromagnetic force of the solenoid portion 53 attracts the movable iron core 55 toward the fixed iron core 54 against the force of the spring 56. Then, the drive force transmitting rod 57 presses the valve body 70H. When the valve body 70H is pressed, the opening degree of the second valve portion 702H decreases, and the first valve portion 701H moves away from the end face of the first valve seat member 91A facing the valve chamber 93A. Accordingly, when electricity is supplied, the solenoid portion 53 applies urging force, which counters the load applied to the valve body 70H based on the point-to-point differential pressure, to the valve body 70H.

Then, the flow rate of refrigerant gas, which is discharged from the control pressure chamber 35 via the second in-shaft passage 21*b*, the first in-shaft passage 21*a*, the first pressure adjusting chamber 151C, the communicating hole 14H, the second pressure adjusting chamber 152C, the passage 82, the communicating hole 522, the valve chamber 93A, the first valve hole 91H, the communicating chamber 66, the communicating hole 523 and the passage 83 to the suction chamber 15A, becomes larger. Therefore, the pressure in the control pressure chamber 35 approaches the pressure in the suction chamber 15A.

Figure 19:
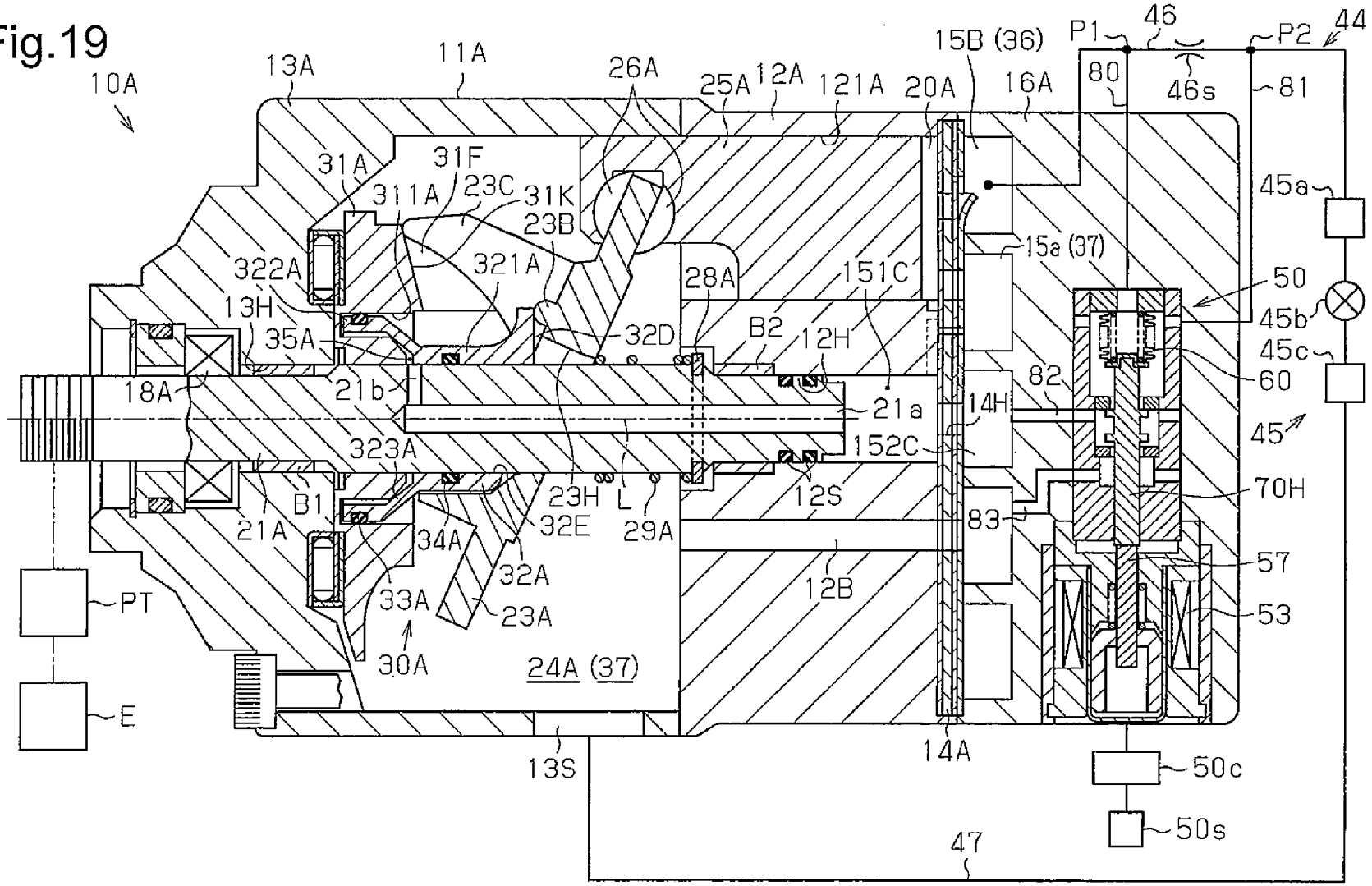
FIG. 19 is a cross-sectional side view illustrating the variable displacement swash plate type compressor when the swash plate is at the maximum inclination angle.
Figure 20:
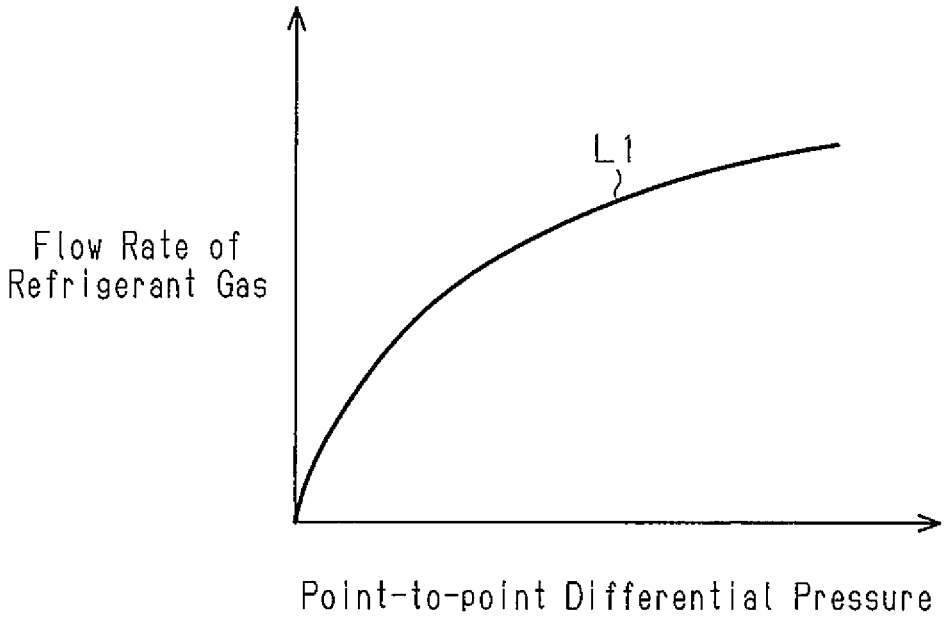
Fig.20(Prior Art)
FIG. 20 is a graph illustrating the relationship between a point-to-point differential pressure and the flow rate of refrigerant gas in a conventional technique.

As illustrated in FIG. 19, as the pressure in the control pressure chamber 35A approaches the pressure in the suction chamber 15A and a pressure difference between the control pressure chamber 35A and the swash plate chamber 24A becomes smaller, the movable body 32A moves so that the first cylindrical portion 321A of the movable body 32A approaches the lug plate 31A. Then, the urging force of the spring 29A urges the swash plate 23A toward the lug plate 31A. This causes the projection 23C to slide on the cam surface 31K in the direction away from the rotary shaft 21A, and thus increases the inclination angle of the swash plate 23A. Accordingly, the stroke of the single-headed pistons 25A becomes larger, and the displacement increases.

As illustrated in FIGS. 17 and 18, the pressure in the communicating chamber 66, i.e., the pressure in the suction chamber 15A acts on a working surface 703H of the first valve portion 701H in the valve body 70H facing the communicating chamber 66. Moreover, the pressure in the accommodation chamber 59, i.e. the pressure at the second pressure monitoring point P2 acts on a working surface 704H of the second valve portion 702H facing the accommodation chamber 59. The end face of the first valve portion 701H facing the valve chamber 93A and the end face of the second valve portion 702H facing the valve chamber 93A have the same pressure receiving area.

Operation of the eleventh embodiment will now be described.

The pressure in the suction chamber 15*a* acts on the working surface 703H of the first valve portion 701H facing the communicating chamber 66, and the pressure at the second pressure monitoring point P2 acts on the working surface 704H of the second valve portion 702H facing the accommodation chamber 59. Accordingly, the load based on the DS differential pressure, which is a differential pressure between the pressure at the second pressure monitoring point P2 and the pressure in the suction chamber 15*a*, acts on the valve body 70H in the same direction as the direction of the load applied to the valve body 70H based on the point-to-point differential pressure. Accordingly, fluctuation in the flow rate of refrigerant gas with respect to fluctuation in the point-to-point differential pressure becomes smaller in a zone where the flow rate of refrigerant gas is small, and this improves controllability of the displacement of the variable displacement swash plate type compressor 10A in a zone where the flow rate of refrigerant gas is small, as in the first embodiment.

Therefore, the eleventh embodiment achieves an advantage equivalent to the advantage (1) of the first embodiment.

Each of the above illustrated embodiments may be modified as follows.

Regarding the first embodiment, the fifth embodiment, the sixth embodiment, the seventh embodiment and the eleventh embodiment, the first valve portions 71*v*, 701C, 705D, 702E and 701H, and the second valve portions 72*v*, 702C, 707D, 704E and 702H may have different outer diameters.

Regarding the second embodiment and the third embodiment, the sealing portions 701A and 701B, and the valve portions 703A and 703B may have different outer diameters.

Regarding the ninth embodiment, the load based on the DS differential pressure does not necessarily need to act on the valve body 70F in the same direction as the direction of the load applied to the valve body 70F based on the point-to-point differential pressure. In such a case, a flow sensor for detecting the flow rate of the control pressure chamber 35 is preferably provided in order to improve the accuracy of estimation of the compressor driving torque.

In the illustrated embodiments, drive power may be obtained from an external drive source via a clutch.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a housing having a suction pressure zone, a discharge pressure zone, and a cylinder bore;

a rotary shaft, which is rotationally supported by the housing;

a swash plate, which is accommodated in the housing and is rotated by drive force from the rotary shaft, wherein an inclination angle of the swash plate is changeable with respect to the rotary shaft;

a piston, which is engaged with the swash plate and reciprocates by a stroke corresponding to the inclination angle of the swash plate;

a movable body, which is coupled to the swash plate and configured to change the inclination angle of the swash plate;

a control pressure chamber, which moves the movable body in a direction in which a rotational axis of the rotary shaft extends as an internal pressure of the control pressure chamber changes, thereby changing the inclination angle of the swash plate; and a control valve, which controls pressure in the control pressure chamber, wherein the variable displacement swash plate type compressor constitutes part of a refrigerant circuit, the refrigerant circuit includes a first pressure monitoring point, and a second pressure monitoring point, which is located on a downstream side of the first pressure monitoring point in a flow direction of refrigerant circulating through the refrigerant circuit, the control valve includes a valve body to which a load is applied based on a point-to-point differential pressure that is a differential pressure between a pressure at the first pressure monitoring point and a pressure at the second pressure monitoring point, wherein the valve body moves in the same direction as a direction of the load to decrease the inclination angle of the swash plate, and a solenoid portion, which controls an opening degree of the valve body by applying urging force, which counters the load applied to the valve body based on the point-to-point differential pressure, to the valve body when receiving electricity supply, and at least one of a load based on a DS differential pressure, which is a differential pressure between a pressure in the discharge pressure zone and a pressure in the suction pressure zone, and a load based on a CS differential pressure, which is a differential pressure between a pressure in the control pressure chamber and a pressure in the suction pressure zone, acts on the valve body in the same direction as the direction of the load applied to the valve body based on the point-to-point differential pressure.

2. The variable displacement swash plate type compressor according to claim 1, wherein at least the load based on the DS differential pressure acts on the valve body in the same direction as the direction of the load applied to the valve body based on the point-to-point differential pressure, and the load based on the CS differential pressure acts on the valve body in the direction opposite to the direction of the load applied to the valve body based on the point-to-point differential pressure.

3. The variable displacement swash plate type compressor according to claim 1, wherein the control valve includes a partition member that is connected to and driven by the valve body, and an accommodation chamber, which accommodates the partition member, the partition member partitions the accommodation chamber into a first introduction chamber, which introduces the pressure at the first pressure monitoring point, and a second introduction chamber, which introduces the pressure at the second pressure monitoring point, and the control valve further includes a back pressure chamber located on the opposite side of the valve body from the accommodation chamber, wherein the control valve introduces the pressure at the second pressure monitoring point.

4. The variable displacement swash plate type compressor according to claim 1, wherein the control valve includes an introduction chamber to which the pressure at the first pressure monitoring point is introduced, and a back pressure chamber, which is located on the opposite side of the valve body from the introduction chamber and introduces the pressure at the second pressure monitoring point.

5. The variable displacement swash plate type compressor according to claim 1, wherein the control valve has a tubular guide member, which guides the valve body in a movement direction of the valve body and is press fitted into a valve housing, a space is defined between the valve body and the guide member, and the valve body has an outer surface sealing portion, which enters the guide member to seal a boundary between the space and an outer side of the guide member.

6. The variable displacement swash plate type compressor according to claim 5, wherein the valve body has an in-shaft passage, which is located inside the guide member and communicates with the space.

7. The variable displacement swash plate type compressor according to claim 1, wherein the inclination angle of the swash plate increases as the internal pressure of the control pressure chamber rises, and the inclination angle of the swash plate decreases as the internal pressure of the control pressure chamber drops.

* * * * *